US011810527B2

(12) United States Patent
Tsuchi

(10) Patent No.: US 11,810,527 B2
(45) Date of Patent: Nov. 7, 2023

(54) DISPLAY DEVICE AND DATA DRIVER

(71) Applicant: LAPIS Technology Co., Ltd., Yokohama (JP)

(72) Inventor: Hiroshi Tsuchi, Yokohama (JP)

(73) Assignee: LAPIS Technology Co., Ltd., Yokohama (JP)

( * ) Notice: Subject to any disclaimer, the term of this patent is extended or adjusted under 35 U.S.C. 154(b) by 0 days.

(21) Appl. No.: 17/857,045

(22) Filed: Jul. 4, 2022

(65) Prior Publication Data

US 2023/0010045 A1 Jan. 12, 2023

(30) Foreign Application Priority Data

Jul. 9, 2021 (JP) ..... 2021-114076

(51) Int. Cl.
*G09G 3/36* (2006.01)
*G09G 3/20* (2006.01)

(52) U.S. Cl.
CPC ..... *G09G 3/3685* (2013.01); *G09G 3/2018* (2013.01); *G09G 3/3614* (2013.01); *G09G 3/3648* (2013.01); *G09G 2310/0291* (2013.01); *G09G 2310/0297* (2013.01); *G09G 2310/08* (2013.01); *G09G 2320/0209* (2013.01); *G09G 2320/0247* (2013.01)

(58) Field of Classification Search
CPC ..... G09G 3/3685
See application file for complete search history.

(56) References Cited

U.S. PATENT DOCUMENTS

2007/0139320 A1* 6/2007 Deane ..... G09G 3/3688 345/87
2015/0022562 A1* 1/2015 Tsubakino ..... G09G 3/3275 345/89
2018/0240423 A1* 8/2018 Park ..... G09G 3/3607
2018/0286305 A1* 10/2018 Kim ..... G09G 3/3275
2019/0204981 A1* 7/2019 Lee ..... G06F 3/0412
2019/0244579 A1* 8/2019 Oh ..... G09G 3/2022
2020/0043435 A1* 2/2020 Kim ..... H03F 3/45179

FOREIGN PATENT DOCUMENTS

JP 2002108288 4/2002

* cited by examiner

*Primary Examiner* — William Boddie
*Assistant Examiner* — Andrew B Schnirel
(74) *Attorney, Agent, or Firm* — JCIPRNET

(57) ABSTRACT

The disclosure includes multiple data drivers provided for each predetermined number of data lines. Each data driver receives an image signal; generates, based on the image signal, a positive gradation data signal and a negative gradation data signal; outputs one of the positive and negative gradation data signals to one of a first and second data line groups of a display panel; and outputs the other of the positive and negative gradation data signals to the other of the first and second data line groups. The data driver shifts a phase of the negative gradation data signal in a direction delayed with respect to the positive gradation data signal, and controls a slew rate of an output amplifier for outputting the positive gradation data signal to be lower than that of an output amplifier for outputting the negative gradation data signal.

20 Claims, 13 Drawing Sheets

DISPLAY DEVICE AND DATA DRIVER

CROSS REFERENCE TO RELATED APPLICATIONS

This application claims priority under 35 USC 119 from Japanese Patent application 2021-114076 filed on Jul. 9, 2021, the disclosure of which is incorporated by reference herein.

BACKGROUND

Technical Field

The disclosure relates to a display device that displays an image corresponding to an image signal, and a data driver included in the display device.

Related Art

Currently, many large-screen display devices employ an active matrix-driven liquid crystal panel as a display device.

Multiple data lines extending in the vertical direction of the two-dimensional screen and multiple gate lines extending in the horizontal direction of the two-dimensional screen are disposed crossing each other on the liquid crystal panel. Further, at each intersection of the multiple data lines and the multiple gate lines, a pixel part including a pixel switch connected to the data line and the gate line is formed. The pixel part includes a transparent electrode that is independently disposed for each pixel, a facing substrate on which one transparent electrode that covers the entire two-dimensional screen of the liquid crystal panel is formed, a liquid crystal material enclosed between each transparent electrode of each pixel and the facing substrate, and a backlight.

The liquid crystal display device includes, together with the liquid crystal panel, a data driver that supplies a gradation data signal having an analog voltage value corresponding to the brightness level of each pixel to a data line with a data pulse in one horizontal scanning period unit, and a gate driver that applies a gate selection signal that controls on/off of a pixel switch to each of the gate lines.

In the liquid crystal display device, when the pixel switch is turned on in response to the gate selection signal transmitted from the gate driver, the gradation data signal transmitted from the data driver is applied to the transparent electrode of the pixel part. Hereinafter, such an operation is referred to as voltage supply to the pixel part or charging (including discharging) to the pixel part or writing to the pixel part. At this time, the transmittance of the liquid crystal changes according to the electric potential difference between the voltage value of the gradation data signal applied to the transparent electrode of each pixel part and the fixed voltage applied to the facing substrate (referred to as the facing substrate voltage), and the display is performed according to the gradation data signal. A structure in which a voltage difference (electric field) in the vertical direction is applied to the substrate as described above with respect to the liquid crystal sandwiched between the transparent electrode of each pixel part and the facing substrate voltage is called a vertical electric field type. In addition, unlike the vertical electric field type, there is also a lateral electric field type having a structure in which a voltage difference (electric field) in the lateral direction is applied with respect to the liquid crystal display on a substrate where a common electrode to which a fixed voltage is applied is provided on the same substrate side as the transparent electrode of each pixel part and where the transparent electrode and the common electrode of each pixel part are disposed together. Hereinafter, for convenience of description, an example of a vertical electric field type liquid crystal display device will be described, but the facing substrate voltage of the vertical electric field type may be replaced with the common electrode voltage of the lateral electric field type.

Further, in the liquid crystal display device, in order to prevent deterioration of its own liquid crystal, a polarity inversion drive is performed in which positive gradation data signals and negative gradation data signals are alternately supplied to the transparent electrode of each pixel part at predetermined frame periods with respect to the facing substrate voltage.

With the recent trend of an increase in the screen size and ultra-high resolution of liquid crystal display devices, the period length of one horizontal scanning period of an image signal is shortened, and the drive period per pixel, that is, the period for supplying the gradation data signal corresponding to one pixel to the data line (also referred to as one data period) is also shortened. As a result, the charge period for the pixels is shortened, and in particular, there is a higher possibility that insufficient charging would occur in the pixels to which the positive gradation data signal is supplied (charged) than in the pixels to which the negative gradation data signal is supplied (charged).

That is, the pixel switch included in each pixel is actually a thin film transistor, and the gradation data signal is supplied to the pixel (transparent electrode) connected to a second terminal of the pixel switch by a current drive capability according to the electric potential difference between the gate selection signal applied to a control terminal and the gradation data signal applied to a first terminal thereof. Therefore, the smaller the electric potential difference between the gate selection signal and the gradation data signal, the smaller the current drive capability of the pixel switch, and the slower the charge speed of the gradation data signal for the pixels.

At this time, the voltage of the positive gradation data signal is generally higher than the voltage of the negative gradation data signal. Therefore, the electric potential difference between the positive gradation data signal and the gate selection signal is smaller than the electric potential difference between the negative gradation data signal and the gate selection signal. As a result, even if the pixel to which the negative gradation data signal is supplied (charged) is charged without excess or deficiency within one data period, the pixel to which the positive gradation data signal is supplied (charged) may be insufficiently charged, and there is a risk that flicker and image quality deterioration may occur in the display image.

Therefore, a liquid crystal drive method has been proposed in which a drive that inverts the polarity of the gradation data signal for each horizontal scanning line is adopted, and the period length of one horizontal scanning period in which writing is performed with the positive gradation data signal is set to be longer than the period length of one horizontal scanning period in which writing is performed with the negative gradation data signal, whereby the above-mentioned problems are solved (see, for example, Japanese Patent Application Laid-open No. 2002-108288).

By the way, with the increase in screen size and ultra-high resolution of the liquid crystal display device, one data period is shortened, and the wiring resistance and wiring capacitance of the gate line and the data line are increased. As a result, in the pixel disposed at the position where the wiring length from the output terminal of the gate driver is long, the bluntness of the edge part of the pulse of the gate selection signal reaching the pixel becomes larger than that of the pixel disposed at the position where the wiring length is short. Further, if the data line having a large electric potential difference due to polarity inversion is frequently charged and discharged, the power consumption (heat generation) of the data driver increases.

Therefore, in a large screen and a high-resolution liquid crystal panel, the polarity of the gradation data signal supplied to the data line is the same within the frame period, and the polarity is different between adjacent data lines, and a so-called column inversion drive (also referred to as a column line inversion drive) is performed in which the polarity of the gradation data signal supplied to each data line is inverted for each frame period.

However, even when the column inversion drive is performed, as described above, even if the pixel to which the negative gradation data signal is supplied is charged without excess or deficiency, the pixel to which the positive gradation data signal is supplied may be insufficiently charged.

FIG. 1 is a waveform diagram showing an example of waveforms of a positive gradation data signal Vdx and a negative gradation data signal Vd (x+1) applied to the Xth and (X+1)th data lines adjacent to each other on the display panel by column inversion drive, respectively, and a gate selection signal Vgk applied to a gate line. In FIG. 1, the first gate line closest to the data driver is GL1, the farthest rth gate line is GLr, and a drive example in which a gate selection signal is sequentially output by the gate driver from the gate line GLr to the gate line GL1 is shown. Further, the positive gradation data signal Vdx and the negative gradation data signal Vd (x+1) output by the data driver also correspond to the selection order of the gate selection signal, and are also sequentially output from the gradation data pulses Dpr and Dnr supplied to the pixels in the rth row, respectively, and finally the gradation data pulses Dp1 and Dn1 supplied to the pixels in the first row are output.

Here, the gradation data signal has an analog voltage value (gradation voltage) supplied to each pixel in the data line direction, and is configured by multiple gradation data pulses in one data period unit. Each gradation data pulse of the positive gradation data signal Vdx has a gradation voltage within a voltage range from a predetermined lower limit value Lpy to a higher upper limit value Lpz on the higher electric potential side than the facing substrate voltage VCOM. Further, the negative gradation data signal Vd (x+1) has a gradation voltage within a voltage range from a predetermined upper limit value Lny to a lower lower limit value Lnz on the lower electric potential side than the facing substrate voltage VCOM. The facing substrate voltage is generally set between the lower limit value Lpy of the positive gradation data signal and the upper limit value Lny of the negative gradation data signal. In the drawings, for convenience of description, the gradation data pulses of the gradation data signals Vdx and Vd (x+1) indicate a drive pattern in which the gradation voltages of the upper limit value and the lower limit value within the respective voltage ranges are alternately output for each data period.

The gate selection signal Vgk is a pulse signal applied to the kth (k is an integer of 2 or more) gate line to be selected and transitions from a predetermined low electric potential VGL state to a high electric potential VGH. The waveform of the gate selection signal is blunted due to the impedance (wiring resistance and wiring capacitance) corresponding to the wiring length of the gate wire from the output terminal of the gate driver. FIG. 1 shows an example of the waveform of the gate selection signal Vgk observed at the position of the gate line intersecting with the X and (X+1)th data lines at the position where the wiring length from the output terminal of the gate driver is relatively long. Further, in the example shown in FIG. 1, in order to improve the pixel charge efficiency, the gate selection signal Vgk maintains a high electric potential VGH state from an earlier data period before the data period in which the positive gradation data pulse Dpk and the negative gradation data pulse Dnk supplied to the pixel on the kth row are output to the Xth and (X+1)th data lines. As a result, as shown in FIG. 1, the pixel on the kth row to be selected is precharged by the gradation data pulses Dp (k+1) and Dn (k+1) immediately before Dpk and Dnk; that is, so-called gate precharge is performed.

Here, the positive data pulse Dpk and the negative data pulse Dnk (k of both is 1, 2, . . . , r) are timing-controlled by the same clock CLK, and their respective phases are set to be the same. The phase timing of the gate selection signal Vgk and the gradation data pulses Dpk and Dnk is determined by the relationship between the lower limit value Lnz of the amplitude of the negative gradation data signal Vd (x+1) and the electric potential of the gate selection signal Vgk, so that the next gradation data pulses Dp (k−1) and Dn (k−1) are not charged for the selected pixel in the kth row. In FIG. 1, the phase timing is adjusted so that the gate signal Vgk falls below the electric potential Lnz at the end of one data period T1H for supplying the gradation data pulse Dnk having the lower limit value Lnz of the negative gradation data signal Vd (x+1).

As a result, the effective pixel charge period Tn1 of the negative gradation data pulse Dnk becomes equivalent to one data period T1H.

In addition, the effective pixel charge period Tp1 of the positive gradation data pulse Dpk is determined by the gradation data pulse Dpk of the lower limit value Lpy of the dynamic range of the positive gradation data signal Vdx and the electric potential of the gate selection signal Vgk.

At this time, the effective pixel charge period Tp1 due to the positive gradation data pulse Dpk is shorter than the one data period T1H by the period Ts1 due to the blunting of the rear edge part of the gate selection signal Vgk as shown in FIG. 1, and the pixel charge rate is reduced by that amount.

Further, as described above, the electric potential difference between the gate selection signal Vgk and the gradation data signal also affects the pixel charge rate, and the pixel charge rate of the positive gradation data signal Vdx is lower than the pixel charge rate of the negative gradation data signal Vd (x+1) having a large electric potential difference.

Therefore, the charge rate based on the positive gradation data signal and the charge rate based on the negative gradation data signal are not consistent, causing a problem that flicker or image quality deterioration occurs in the display image.

At this time, when the column inversion drive is performed, the pixels to which the positive gradation data signal is supplied and the pixels to which the negative gradation data signal is supplied are mixed along one horizontal scanning line; therefore, the above-mentioned problem cannot be solved by the method described in Japanese Patent Application Laid-open No. 2002-108288.

By the way, in performing column inversion drive, it is conceivable to reduce the difference between the pixel charge rate due to the gate selection signal and the negative gradation data signal with blunt at the rear edge part, and the pixel charge rate due to the gate selection signal and the positive gradation data signal, by delaying the phase of the negative gradation data signal with respect to the positive gradation data signal.

However, when an image with a gray background including a relatively large white square area WE is displayed in the center of the screen as shown in FIG. 2, for example, by such column inversion drive, there arises a problem that streak unevenness (referred to as crosstalk) appears along the upper and lower sides of the white square area WE.

The causes of such crosstalk will be described below with reference to FIG. 3.

FIG. 3 is a waveform diagram showing the waveforms of the data signals transmitted to the data lines Df and D (f+1) passing through the white square area WE and the data lines Dg and D (g+1) not passing through the white square area WE, respectively, and the voltage waveform of the facing substrate voltage VCOM while the gate selection signal is supplied to the gate line Ga along the upper side of the white square area WE shown in FIG. 2. In the following, a case will be described in which the liquid crystal material has a characteristic that the larger the voltage difference between the facing substrate voltage VCOM and each pixel electrode, the larger the liquid crystal transmittance (displayed in white).

As shown in FIG. 3, in the data line Df, the level of the positive gradation data signal increases from the level Vp_gy representing gray to the level Vp_wt representing white at the time point Tp. Further, in the data line D (f+1), the level of the negative gradation data signal decreases from the level Vn_gy representing gray to the level Vn_wt representing white at the time point Tn when a predetermined period has elapsed from the time point Tp. Further, as shown in FIG. 3, in the data line Dg that does not pass through the white square area WE, the positive gradation data signal maintains the level Vp_gy, and in the data line D (g+1) that does not pass through the white square area WE, the negative gradation data signal maintains the level Vn_gy.

At this time, the facing substrate voltage VCOM causes a large wide voltage fluctuation due to the capacitive coupling in the liquid crystal panel according to the increase of the voltage of the positive gradation data signal applied to the data line Df and the decrease of the voltage of the negative gradation data signal applied to the data line D (f+1). The magnitude of the voltage fluctuation of the facing substrate voltage VCOM depends on the width of the edge of the white square area WE shown in FIG. 2 (the number of data lines that cause a voltage change at the edge of the white square area WE), the timing difference of change to the voltage level representing white of each of the positive gradation data signal and the negative gradation data signal, the speed of change of the voltage level (the magnitude of the slew rate of the positive and negative output amplifiers), and the like. Then, the voltage fluctuation of the facing substrate voltage VCOM generated at the edge of the white square area WE propagates in the panel surface to which the facing substrate electrodes are connected. As a result, for example, when the electric potential difference between the pixel electrode at the intersection of the gate lines Ga and Gb of the data lines Dg and D (g+1) that do not pass through the white square area WE and the facing substrate electrode is maintained in a state of being deviated from the expected value, each pixel disposed along the gate lines Ga and Gb has a brightness different from the original gray background. For example, in FIG. 3, at the end of the 1H period selected by the gate line Ga, in the pixel to which the positive gradation data signal of the data line Df is supplied, the facing substrate voltage VCOM increases; therefore, the voltage applied to the liquid crystal of the pixel (difference voltage between the gradation data signal and the voltage VCOM) is maintained for one frame period in a state where the voltage is reduced from the expected value, and the brightness drops below the expected value. Further, in the pixel to which the negative gradation data signal of the data line D (f+1) is supplied, the facing substrate voltage VCOM increases; therefore, the voltage applied to the liquid crystal of the pixel is maintained for one frame period in a state where the voltage is increased from the expected value, and the brightness rises above the expected value. However, since these pixels are located at the boundary where the color change occurs and the brightness is high white, the human cannot visually recognize a slight change in brightness due to the fluctuation of the facing substrate voltage VCOM. In addition, at the end of the 1H period selected by the gate line Ga, in the pixel to which the gradation data signal of the data line Dg that does not pass through the white square area WE is supplied, the facing substrate voltage VCOM increases; therefore, the voltage applied to the liquid crystal of the pixel is maintained for one frame period in a state where the voltage is reduced from the expected value, and the brightness drops below the expected value. Further, in the pixel to which the gradation data signal of the data line D (g+1) is supplied, the facing substrate voltage VCOM increases; therefore, the voltage applied to the liquid crystal of the pixel is maintained for one frame period in a state where the voltage is increased from the expected value, and the brightness rises above the expected value. Since these pixels have a change in brightness above a certain level, the brightness of each of the positive and negative pixels is offset in the non-linear gamma characteristic, and since they are located in a gray display area where human visual sensitivity is high, it is easy to see the difference in brightness from the surroundings. As a result, as shown in FIG. 2, streak unevenness along the gate line Ga on a gray background becomes visible. Similarly, streak unevenness along the gate line Gb is also visible. When the voltage fluctuation of the facing substrate voltage VCOM is large and extends over multiple data periods, streak unevenness may occur in each pixel along the gate line selected after the gate lines Ga and Gb. In addition, when the timing difference between the positive gradation data signal and the negative gradation data signal is sufficiently small, the capacitive coupling is offset between the positive polarity and the negative polarity; therefore, the fluctuation range of the facing substrate voltage VCOM is very small, and the crosstalk is sufficiently small.

Therefore, the disclosure provides a display device and a data driver capable of displaying an image in which image quality deterioration such as flicker and crosstalk is suppressed by column inversion drive.

SUMMARY

A display device according to the disclosure includes: a display panel which includes multiple data lines including a first data line group and a second data line group, multiple gate lines disposed intersecting with the data lines, and display cells as pixels disposed at each intersection of the data lines and the gate lines; a gate driver which supplies a gate selection signal to each of the gate lines; and multiple data drivers provided for each predetermined number of data lines, and each data driver receives an image signal and generates, based on the image signal, a positive gradation data signal higher than a predetermined reference voltage and a negative gradation data signal lower than the predetermined reference voltage, outputs one of the positive gradation data signal and the negative gradation data signal to one data line group of the first data line group and the second data line group, and outputs the other of the positive gradation data signal and the negative gradation data signal to the other data line group of the first data line group and the second data line group. The data driver: includes multiple output amplifiers, each output amplifier outputting one of the positive gradation data signal and the negative gradation data; generates a signal as the positive gradation data signal in which a data pulse having a positive voltage value corresponding to a brightness level of each pixel based on the image signal appears in a predetermined cycle, and generates a signal as the negative gradation data signal in which a data pulse having a negative voltage value corresponding to the brightness level of each pixel based on the image signal appears at every predetermined cycle in a phase shifted in a direction delayed with respect to a phase of the positive gradation data signal; and controls a slew rate of an output amplifier responsible for an output of the positive gradation data signal among the output amplifiers to be lower than a slew rate of an output amplifier responsible for an output of the negative gradation data signal.

A data driver according to the disclosure receives an image signal and generates, based on the image signal, a positive gradation data signal higher than a predetermined reference voltage and a negative gradation data signal lower than the predetermined reference voltage, outputs one of the positive gradation data signal and the negative gradation data signal to one data line group of a first data line group and a second data line group of a display panel, and outputs the other of the positive gradation data signal and the negative gradation data signal to the other data line group of the first data line group and the second data line group. The data driver: includes multiple output amplifiers, each output amplifier outputting one of the positive gradation data signal and the negative gradation data signal; generates a signal as the positive gradation data signal in which a data pulse having a positive voltage value corresponding to a brightness level of each pixel based on the image signal appears in a predetermined cycle, and generates a signal as the negative gradation data signal in which a data pulse having a negative voltage value corresponding to the brightness level of each pixel based on the image signal appears at every predetermined cycle in a phase shifted in a direction delayed with respect to a phase of the positive gradation data signal; and controls a slew rate of an output amplifier responsible for an output of the positive gradation data signal among the output amplifiers to be lower than a slew rate of an output amplifier responsible for an output of the negative gradation data signal.

Effects

In the disclosure, in performing column inversion drive in which the polarity of the gradation data signal output to each data line of the display panel is switched every frame period, the phase of the negative gradation data signal is shifted in the direction delayed with respect to the positive gradation data signal. As a result, even in a state where blunting occurs at the rear edge part of the gate selection signal, the difference between the pixel charge rate due to the negative gradation data signal and the pixel charge rate due to the positive gradation data signal may be reduced. Therefore, it is possible to suppress flicker caused by the difference between the pixel charge rate due to the negative gradation data signal and the pixel charge rate due to the positive gradation data signal.

Further, in the disclosure, the slew rate of the output amplifier that outputs the positive gradation data signal is lower than the slew rate of the output amplifier that outputs the negative gradation data signal. As a result, the peak of the fluctuation of the facing substrate voltage due to the capacitive coupling between the data line and the facing substrate electrode, which is caused by delaying the phase of the negative gradation data signal with respect to the positive gradation data signal, may be reduced; therefore, it is possible to suppress the crosstalk (streak unevenness) that appears in the display image due to the fluctuation of the facing substrate voltage.

Therefore, according to the disclosure, when the display panel is driven by column driving, it is possible to perform image display in which image quality deterioration such as flicker and crosstalk (streak unevenness) is suppressed.

DETAILED DESCRIPTION

Figure 4:
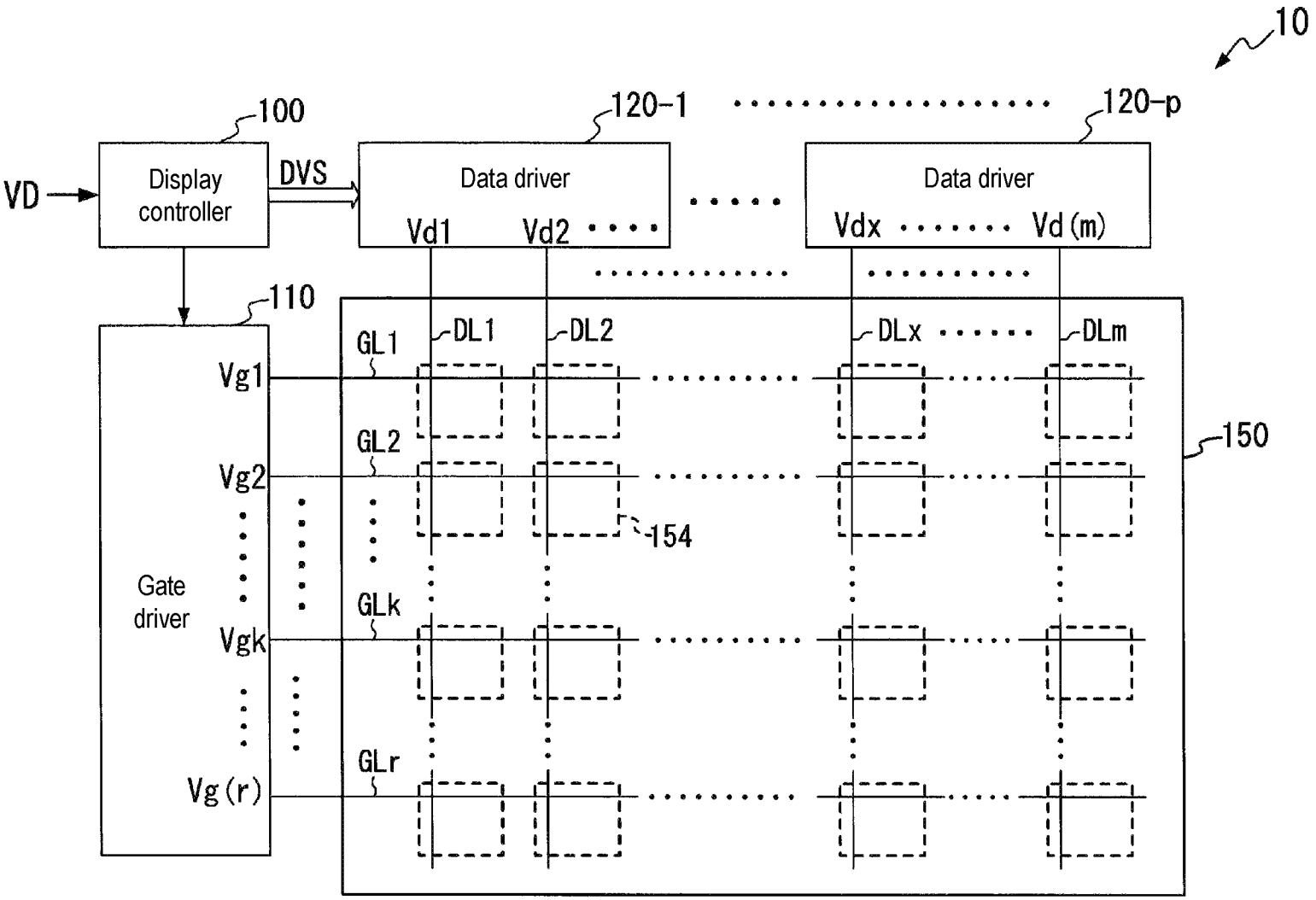
FIG. 4 is a block diagram showing a schematic configuration of a liquid crystal display device as a display device according to the disclosure.

FIG. 4 is a block diagram showing a schematic configuration of an active matrix type liquid crystal display device 10 as a display device according to the disclosure.

As shown in FIG. 4, the liquid crystal display device 10 includes a display controller 100, data drivers 120-1 to **120-*p*, a gate driver 110, and a display panel 150**.

As shown in FIG. 4, in the display panel 150, gate lines GL1 to GLr (r is an integer of 2 or more) extending in the horizontal direction of the two-dimensional screen and data lines DL1 to DLm (m is an integer of 2 or more) extending in the vertical direction of the two-dimensional screen are disposed crossing each other. The data drivers 120-1 to **120-*p* are provided for each predetermined number of data lines, and a total of p (p is an integer greater than 1) data drivers drives the data lines DL1 to DLm of the display panel 150. The gate driver 110 for driving the gate lines GL1 to GLr is mainly configured by a thin film transistor circuit integrally formed with the display panel 150 due to a demand for a narrow frame. A display cell 154 as a unit pixel is formed at the intersection of each of the gate lines GL1 to GLr and each of the data lines DL1** to DLm.

In FIG. 4, the gate driver 110 is shown to be disposed on one side of the display panel 150. However, two gate drivers 110 may be disposed at the left and right ends of the two-dimensional screen in the display panel 150, respectively, and the gate lines GL1 to GLr may be driven by each gate driver 110.

Figure 5:
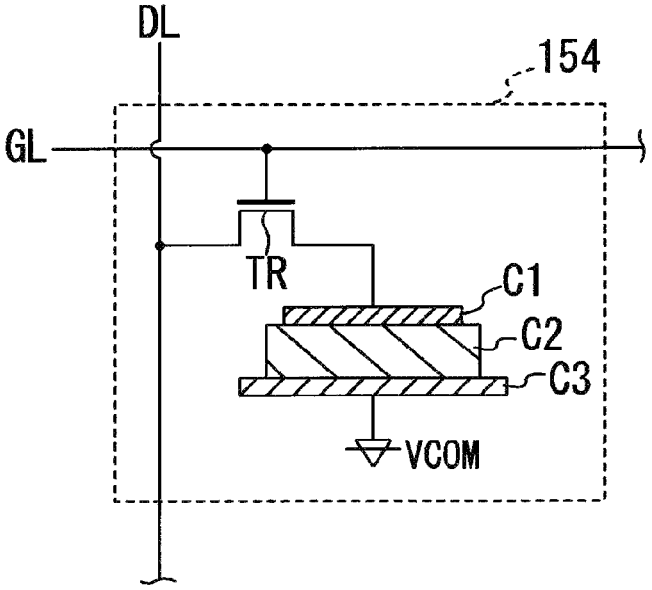
FIG. 5 is a diagram schematically showing an example of the structure of the display cell.

FIG. 5 is a diagram schematically showing the structure of the display cell 154.

As shown in FIG. 5, the display cell 154 includes a pixel electrode C1, a liquid crystal layer C2 and a facing substrate electrode C3 stacked on each other, and a thin film transistor TR as a pixel switch. Further, FIG. 5 shows an example of an n-channel type thin film transistor.

The pixel electrode C1 is a transparent electrode independently provided for each display cell 154, and the facing substrate electrode C3 is a single transparent electrode covering the entire surface of the display panel 150. The control terminal of the transistor TR is connected to the gate line GL, and the first terminal thereof is connected to the data line DL. Further, the second terminal of the transistor TR is connected to the pixel electrode C1. The facing substrate voltage VCOM as a reference voltage is applied to the facing substrate electrode C3.

Further, in FIG. 4, the display controller 100 generates a control signal group CS, a series of image data PD indicating the brightness level of each pixel, and an image signal DVS representing digital setting information in a serial digital signal form based on an image signal VD.

The control signal group CS includes a vertical return signal Vsync of a reference signal of a frame cycle, a horizontal return signal Hsync of a reference signal of a data period, a clock signal CLK, and the like. The digital setting information includes output delay direction information CF, output delay shift amount information SA1 and SA2, and output start timing information TA1 and TA2.

The output delay direction information CF is information that specifies the following increase directions of the output delay time for i output channels that output i (i is an integer of 2 or more) gradation data signals Vd for each of the data drivers 120-1 to **120-*p*. That is, the output delay direction information CF is information that specifies whether to increase the output delay time increase direction from each of the positive and negative output start channels in the ascending order or the descending order of the output channel numbers, or to increase the output delay time from both ends of the i output channels toward the center. The output delay direction information CF of the positive polarity and the negative polarity is common. Specifically, for example, when the gate drivers are disposed at the left and right ends of the two-dimensional screen of the display panel, and data drivers 120-1 to 120-*p*** are disposed side by side along the horizontal direction at the lower end (or the upper end) of the two-dimensional screen, the contents of the output delay direction information CF are as follows. That is, in the output delay direction information CF of each data driver IC on the left half of the two-dimensional screen, the direction is specified to increase the output delay time from the first output channel to the i-output channel corresponding to the direction in which the gate selection signal delay increases from the left end gate driver toward the center of the screen for the i output channels. Further, in the output delay direction information CF of each data driver IC on the right half of the two-dimensional screen, the direction is specified to increase the output delay time from the i-th output channel to the first output channel corresponding to the direction in which the gate selection signal delay increases from the right end gate driver toward the center of the screen for the i output channels. Further, since the output delay direction information CF is used to correct the data line fan-out wiring length at the end of the display panel on which the data driver IC is mounted, the direction may be specified to increase the output delay time from both ends of the i output channels toward the center.

The output delay shift amount information SA1 is information that specifies the delay shift amount set in the output channel group responsible for the output of the positive gradation data signal Vd for each of the data drivers 120-1 to **120-*p*. The output delay shift amount information SA2 is information that specifies the delay shift amount set in the output channel group responsible for the output of the negative gradation data signal Vd for each of the data drivers 120-1 to 120-*p***. The delay shift amount is the amount of change in the delay time per predetermined output channel number unit xr (ascending order direction of the output channel number) or xl (descending order direction of the output channel number) (however, xr<i, and xl<i), and is expressed stepwise, for example, by an integral multiple of the pulse width of the clock signal CLK.

The output start timing information TA1 is information that specifies the output timing of the output start channel for the output channel group responsible for the output of the positive gradation data signal Vd for each of the data drivers 120-1 to **120-*p*. The output start timing information TA2 is information that specifies the output timing of the output start channel for the output channel group responsible for the output of the gradation data signal Vd group on the negative side for each of the data drivers 120-1 to 120-*p*. The positive and negative output start channel specification information may be included in the output start timing information TA1 and TA2**, respectively. Alternatively, the output channel may be specified corresponding to the output delay direction information CF.

The display controller 100 supplies the image signal DVS generated as described above to each of the data drivers 120-1 to **120-*p*, and supplies the gate timing signal indicating the timing of applying the gate selection signal to the gate driver 110**.

The gate driver 110 sequentially generates gate selection signals Vg1 to Vg (r) including at least one pulse for selecting a gate line according to the gate timing signal, and outputs them individually from each of the r output terminals. The gate driver 110 supplies the gate selection signals Vg1 to Vg (r) output from the r output terminals to each of the gate lines GL1 to GLr of the display panel 150.

The data drivers 120-1 to **120-*p* are configured by, for example, p independent ICs, and are provided for each i (i is an integer of 2 or more) of the data lines DL1 to DLm of the display panel 150. Each of the data drivers 120-1 to 120-*p* generates i positive or negative gradation data signals Vd1 to Vdi having an analog voltage value corresponding to the brightness level of each pixel according to the image signal DVS, and supplies each to the i data lines DL of the corresponding display panel 150**.

The data drivers 120-1 to **120-*p* supply positive gradation data signals to one of a pair of data lines that are adjacent during a certain frame period among the gradation data signals Vd1 to Vdi, and performs a column inversion drive to supply a negative gradation data signal to the other data line. Then, the polarity state of each gradation data signal is inverted in frame units. The simplest method is to set the polarities of each of the gradation data signals Vd1, Vd3, Vd5, etc. to be supplied to the odd-numbered data lines of the display panel to one of the positive polarity and the negative polarity, and set the polarities of each of the gradation data signals Vd2, Vd4, Vd6**, etc. to be supplied to the even-numbered data lines as the other of the positive polarity and the negative polarity, and the polarity state of each may be inverted for each frame.

Further, when the data drivers 120-1 to **120-*p* output the gradation data signals Vd1 to Vdi, the negative gradation data signal group of the gradation data signals Vd1** to Vdi is output at a timing delayed by a predetermined period from the positive gradation data signal group.

Figure 6:
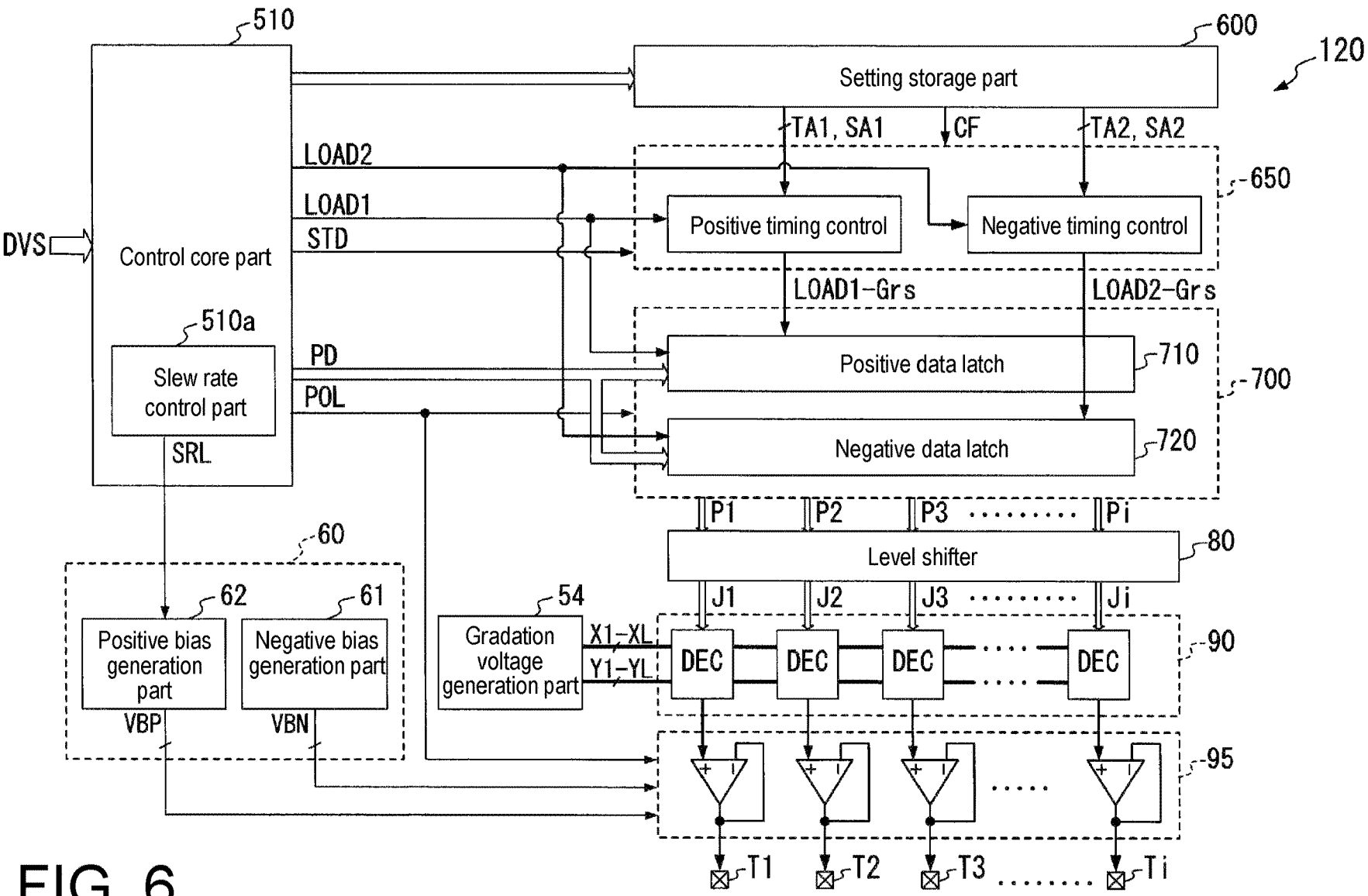
FIG. 6 is a block diagram showing an example of the internal configuration of the data driver 120.

FIG. 6 is a block diagram showing an internal configuration of one data driver 120 extracted from the data drivers 120-1 to **120-*p***.

As shown in FIG. 6, the data driver 120 includes a control core part 510, a setting storage part 600, a timing control part 650, a latch part 700, a gradation voltage generation part 54, a negative bias generation part 61, and a positive bias generation part 62, a level shifter 80, a decoder part 90, and an output amplifier part 95.

The control core part 510 separates and extracts the series of image data PD corresponding to each display cell 154, the various signal groups described above, and the setting information by performing serial-parallel conversion processing on the image signal DVS in serial form, and supplies each to the corresponding block.

That is, the control core part 510 extracts the series of image data PD, the digital setting information (CF, SA1, SA2, TA1, TA2) and the clock signal CLK from the image signal DVS. The control core part 510 supplies the digital setting information (CF, SA1, SA2, TA1, TA2) to the setting storage part 600, supplies the reference timing signal STD to the timing control part 650, and supplies the series of the image data PD to the latch part 700.

Further, the control core part 510 generates the reference timing signal STD of one horizontal period cycle (1H cycle) according to the image signal DVS. The reference timing signal STD may be, for example, a signal synchronized with the gate-off timing of the gate selection signal.

Further, the control core part 510 generates a polarity inversion signal POL, and a latch output timing signal LOAD1 for the positive polarity and a latch output timing signal LOAD2 for the negative polarity for taking the image data signals for the positive polarity and the negative polarity into the latch part 700 according to the image signal DVS. The control core part 510 supplies the polarity inversion signal POL to the output amplifier part 95 and the latch part 700, and supplies the latch output timing signals LOAD1 and LOAD2 to the timing control part 650 and the latch part 700.

The polarity inversion signal POL is, for example, a binary frequency signal (logic levels 0 and 1) representing a positive polarity on one side and a negative polarity on the other side of logic levels 0 and 1.

The latch output timing signals LOAD1 and LOAD2 are signals generated with a delay amount based on the control signal group CS and the digital setting information with respect to the reference timing signal STD.

Figure 7:
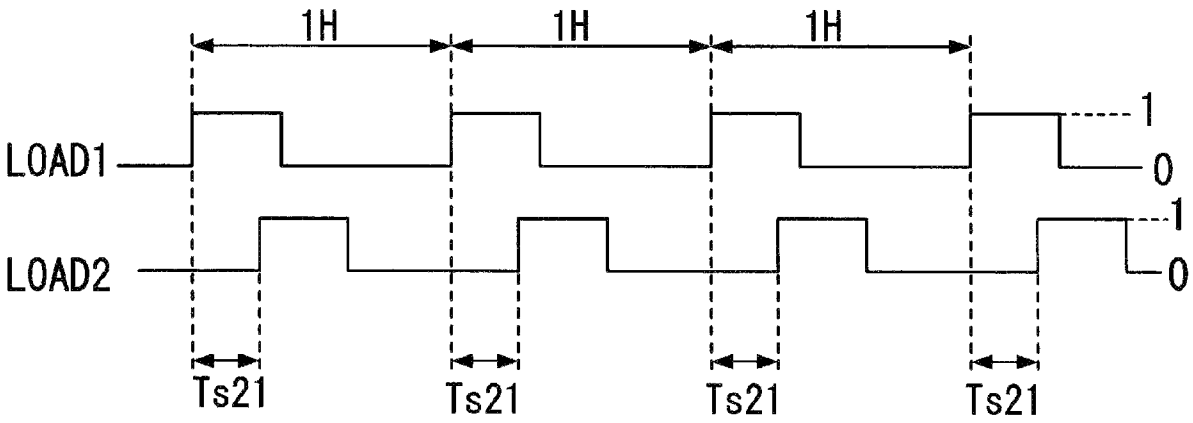
FIG. 7 is a waveform diagram showing an example of waveforms of the latch output timing signals LOAD1 and LOAD2.

FIG. 7 is a diagram showing an example of waveforms of the latch output timing signals LOAD1 and LOAD2.

As shown in FIG. 7, the latch output timing signals LOAD1 and LOAD2 are binary signals in which a pulse having a voltage value corresponding to the logic level 0 and a pulse having a voltage value corresponding to the logic level 1 appear alternately for each horizontal scanning period (1H). At this time, the latch output timing signal LOAD2 for the negative polarity is a signal in which the phase of the latch output timing signal LOAD1 for the positive polarity is delayed by the time Ts21 as shown in FIG. 7. The time Ts21 is a preset time based on the voltage change rate with the elapse of time at the rear edge part of the gate selection signal.

Further, the control core part 510 includes a slew rate control part **510*a***.

The slew rate control parts **510*a* generates a slew rate control signal SRL that lowers the slew rate of the output amplifier responsible for the output of the positive gradation data signal among the multiple output amplifiers included in the output amplifier part 95 corresponding to the phase difference between the latch output timing signal LOAD1 for the positive polarity and the latch output timing signal LOAD2 for the negative polarity (time Ts21 shown in FIG. 7), supplies it to the slew rate setting part 60**.

The setting storage part 600 captures and stores the digital setting information (CF, SA1, SA2, TA1, TA2) supplied from the control core part 510. The setting storage part 600 supplies the stored digital setting information, that is, the output delay direction information CF, the output delay shift amount information SA1 and SA2, and the output start timing information TA1 and TA2 to the timing control part 650. The digital setting information stored in the setting storage part 600 is refreshed at predetermined cycles.

The timing control part 650 includes a positive timing control part and a negative timing control part as functional blocks for the positive polarity and the negative polarity, and generates a timing signal for outputting an image data signal corresponding to each of the positive polarity and the negative polarity captured in the latch part 700.

That is, the positive timing control part of the timing control part 650 generates the latch output timing signal group LOAD1-Grs of the image data signal for the positive polarity based on the output delay direction information CF, the output delay shift amount information SA1, the output start timing information TA1, the reference timing signal STD, and the latch output timing signal LOAD1.

The negative timing control part of the timing control part 650 generates the latch output timing signal group LOAD2-Grs of the image data signal for the negative polarity based on the output delay direction information CF, the output delay shift amount information SA2, the output start timing information TA2, the reference timing signal STD, and the latch output timing signal LOAD2.

The timing control part 650 supplies the latch output timing signal groups LOAD1-Grs and LOAD2-Grs generated as described above to the latch part 700.

The latch part 700 includes a positive data latch 710 and a negative data latch 720. The latch part 700 distributes each image data PD in the series of image data PD for the positive polarity and the negative polarity according to the polarity inversion signal POL.

The positive data latch 710 captures each of the image data PD distributed to the positive polarity according to the latch output timing signal LOAD1. Then, the positive data latch 710 outputs each of the captured positive image data PD as image data P at the output timing set for each predetermined output number unit based on the output timing signal group LOAD1-Grs corresponding to the output channels corresponding to each of the captured positive image data PD.

The negative data latch 720 captures each of the image data PD distributed to the negative polarity according to the latch output timing signal LOAD2. Then, the negative data latch 720 outputs each of the captured negative image data PD as image data P at the output timing set for each predetermined output number unit based on the output timing signal group LOAD2-Grs corresponding to the output channels corresponding to each of the captured negative image data PD.

The latch part 700 supplies i (i is an integer of 2 or more) image data P output from the positive data latch 710 and the negative data latch 720 to the level shifter 80 as image data P1 to Pi.

The level shifter 80 supplies the image data J1 to Ji obtained by subjecting each of the i image data P1 to Pi supplied from the latch part 700 to a level shift processing for increasing the signal level (voltage amplitude) of the data to the decoder part 90.

The gradation voltage generation part 54 generates L (L is an integer of 2 or more) voltages having a voltage value different from each other and having a voltage value higher than the facing substrate voltage VCOM, which serves as the reference voltage, as a positive reference voltage group X1 to XL representing the brightness level of the pixel by L stages. Further, the gradation voltage generation part 54 generates L voltages having a voltage value different from each other and having a voltage value lower than the facing substrate voltage VCOM as a negative reference voltage group Y1 to YL representing the brightness level of the pixel by L stages. For example, the gradation voltage generation part 54 divides a predetermined high electric potential VGH and a predetermined low electric potential VGL lower than the high electric potential VGH into multiple voltages by a ladder resistor, thereby generating a reference voltage group each having a different voltage value.

The gradation voltage generation part 54 supplies the generated positive reference voltage group X1 to XL and the negative reference voltage group Y1 to YL to the decoder part 90.

The decoder part 90 has i decoders DEC that individually convert each of the image data J1 to Ji into a gradation data signal having an analog voltage value.

Each of the decoders DEC receives the positive reference voltage group X1 to XL and the negative reference voltage group Y1 to YL from the gradation voltage generation part 54. Further, each of the i decoders DEC individually receives one of the image data J1 to Ji.

When the image data J received by each decoder is the positive data, the decoder DEC selects one or multiple reference voltages specified by the image data J from the positive reference voltage group X1 to XL. On the other hand, when the image data J received by each decoder is the negative data, the decoder DEC selects one or multiple reference voltages specified by the image data J from the negative reference voltage group Y1 to YL.

The decoder part 90 outputs one or multiple reference voltages selected by each decoder DEC to the output amplifier part 95 as a gradation voltage corresponding to the brightness level of each pixel.

The output amplifier part 95 has i output amplifiers (operational amplifiers) corresponding to the i decoders DEC included in the decoder part 90. Each of the output amplifiers is a voltage follower in which its own output terminal and inverting input terminal (−) are connected to each other, and receives one or more gradation voltages supplied from the corresponding decoders DEC at its non-inverting input terminal (+). Each of the i output amplifiers amplifies one or more gradation voltages received by its own non-inverting input terminal (+) to generate a pulse voltage having a voltage value corresponding to the gradation voltage as a gradation data pulse corresponding to the brightness level, and outputs it as a gradation data pulse via the output terminal. The gradation data pulse is continuously output for each data period (for example, one horizontal scanning period) within one frame period. Each of the i output amplifiers outputs a signal including a series of gradation data pulses appearing for each data period as a gradation data signal Vd to the outside via i external terminals T1 to Ti of the semiconductor IC. Here, the i external terminals T1 to Ti are individually connected to i of the data lines DL1 to DLm of the display panel 150. For example, when the data driver 120 is the data driver 120-1 in charge of DL1 to DLi of the data lines DL1 to DLm, the gradation data signals Vd1 to Vdi are output from the external terminals Ti to Ti of the data driver 120, respectively.

The slew rate setting part 60 includes a negative bias generation part 61 and a positive bias generation part 62.

The negative bias generation part 61 generates a bias voltage group VBN for an output amplifier (also referred to as a negative output amplifier) which is responsible for the output of the negative gradation data signal among the i output amplifiers, and the bias voltage group VBN sets the current amount of the bias current flowing in the output amplifier to a predetermined amount in order to operate the output amplifier. Then, the negative bias generation part 61 supplies the generated bias voltage group VBN to each of the negative output amplifiers.

The positive bias generation part 62 generates a bias voltage group VBP for an output amplifier (also referred to as a positive amplifier) which is responsible for the output of the positive gradation data signal among the i output amplifiers based on the slew rate control signal SRL described above, and the bias voltage group VBP sets the current amount of the bias current flowing in the output amplifier in order to operate the output amplifier. Specifically, the positive bias generation part 62 generates the bias voltage group VBP that reduces the current amount of bias current for operating the positive output amplifier as the phase difference (Ts21) between the latch output timing signals LOAD1 and LOAD2 indicated by the slew rate control signal SRL increases. At this time, the lower the bias current of the positive output amplifier, the lower the slew rate when outputting the gradation data signal. The positive bias generation part 62 supplies the bias voltage group VBP generated as described above to each of the positive output amplifiers.

With the above configuration, the slew rate setting part 60 sets the output amplifier part 95 to lower the slew rate of the positive output amplifier as compared with the negative output amplifier included in the output amplifier part 95, corresponding to the phase difference between the latch output timing signals LOAD1 and LOAD2 indicated by the slew rate control signal SRL. When the phase difference between the latch output timing signals LOAD1 and LOAD2 indicated by the slew rate control signal SRL is zero, the slew rate setting part 60 generates bias voltage groups VBP and VBN that equalize the slew rate of the output amplifier responsible for the output of the negative gradation data signal and the output amplifier responsible for the output of the positive gradation data signal.

The column inversion drive by the data driver 120 shown in FIG. 6 will be described below.

Figure 8:
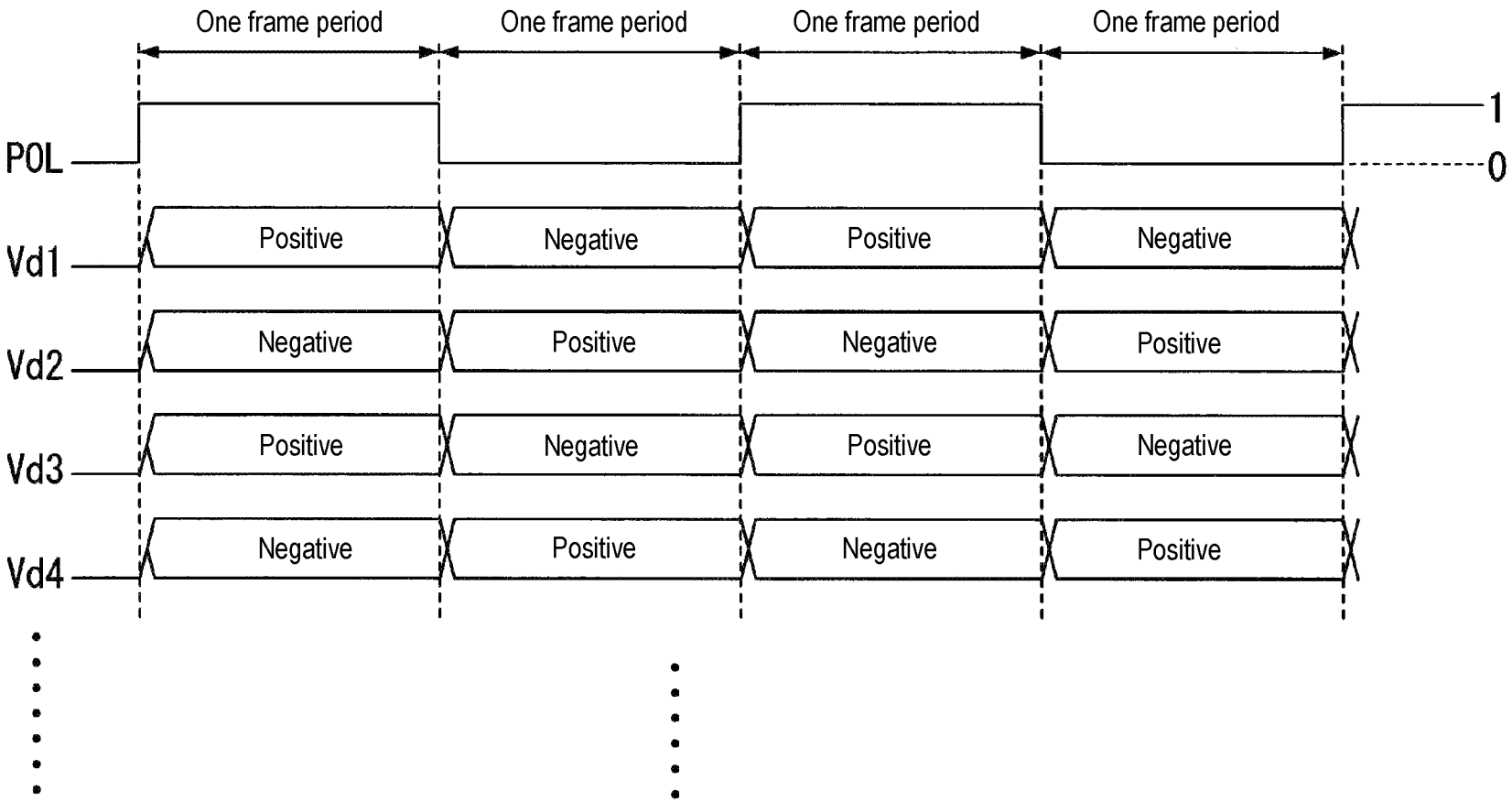
FIG. 8 is a time chart showing an example of changes in the polarity states (positive polarity or negative polarity) of each of the gradation data signals Vd1 to Vd4 output from the data driver 120.

FIG. 8 is a time chart showing changes in the polarity states (positive polarity or negative polarity) of four signals Vd1 to Vd4 extracted from the gradation data signals Vd1 to Vdi output from the data driver 120.

As shown in FIG. 8, for example, in one frame period in which the polarity inversion signal POL becomes logic level 1, the positive data latch 710 of the latch part 700 captures each of the odd-numbered image data PD in the series of image data PD for one horizontal scanning line as positive data. Further, during this period, the negative data latch 720 of the latch part 700 captures each of the even-numbered image data PD in the series of image data PD for one horizontal scanning line as negative data.

Then, in one frame period in which the polarity inversion signal POL becomes the logic level 1, the positive data latch 710 outputs each of the odd-numbered image data PD serving as positive data as the odd-numbered image data P1, P3, P5, P7, etc. Further, during this period, the negative data latch 720 outputs each of the even-numbered image data PD serving as negative data as the even-numbered image data P2, P4, P6, P8, etc.

As a result, as shown in FIG. 8, in one frame period in which the polarity inversion signal POL becomes the logic level 1, each of the odd-numbered gradation data signals Vd1 and Vd3 of the gradation data signals Vd1 to Vd4 applied to the data lines DL1 to DL4 of the display panel 150 has a positive polarity. Further, in one frame period in which the polarity inversion signal POL becomes the logic level 1, as shown in FIG. 8, each of the even-numbered gradation data signals Vd2 and Vd4 has a negative polarity.

Further, as shown in FIG. 8, in one frame period in which the polarity inversion signal POL becomes logic level 0, the positive data latch 710 captures each of the even-numbered image data PD in the series of image data PD for one horizontal scanning line as positive data. Further, during this period, the negative data latch 720 captures each of the odd-numbered image data PD in the series of image data PD for one horizontal scanning line as negative data.

Then, in one frame period in which the polarity inversion signal POL becomes the logic level 0, the positive data latch 710 outputs each of the even-numbered image data PD serving as positive data as the even-numbered image data P2, P4, P6, P8, etc. Further, during this period, the negative data latch 720 outputs each of the odd-numbered image data PD serving as negative data as the odd-numbered image data P1, P3, P5, P7, etc.

As a result, as shown in FIG. 8, in one frame period in which the polarity inversion signal POL becomes the logic level 0, each of the odd-numbered gradation data signals Vd1 and Vd3 of the gradation data signals Vd1 to Vd4 applied to the data lines DL1 to DL4 of the display panel 150 has a negative polarity. Further, in one frame period in which the polarity inversion signal POL becomes the logic level 0, as shown in FIG. 8, each of the even-numbered gradation data signals Vd2 and Vd4 has a positive polarity. For convenience of description, the example in which the polarities of the data lines of the display panel 150 are different between the even number and the odd number has been described, but the order of the polarities of the data lines may be changed as appropriate.

By the way, each of the gradation data signals Vd1 to Vd4 as shown in FIG. 8 includes a series of pulses in which r gradation data pulses corresponding to r display cells 154 disposed along each of the data lines DL1 to DL4 are continuous for each cycle of one horizontal scanning period (1H).

At this time, in the display cell 154 that receives the pulsed gate selection signal Vg transmitted from the gate driver 110 via the gate line GL and receives the gradation data signal Vd transmitted from the data driver 120, the gradation data pulse is supplied (charged) to the pixel electrode via the pixel switch. That is, the gradation data pulse is supplied to the display cell 154 with the current drive capability corresponding to the electric potential difference between the electric potential of the gradation data pulse and the electric potential of the gate selection signal Vg, and the display cell 154 is held at the voltage value of this gradation data pulse.

Figure 9:
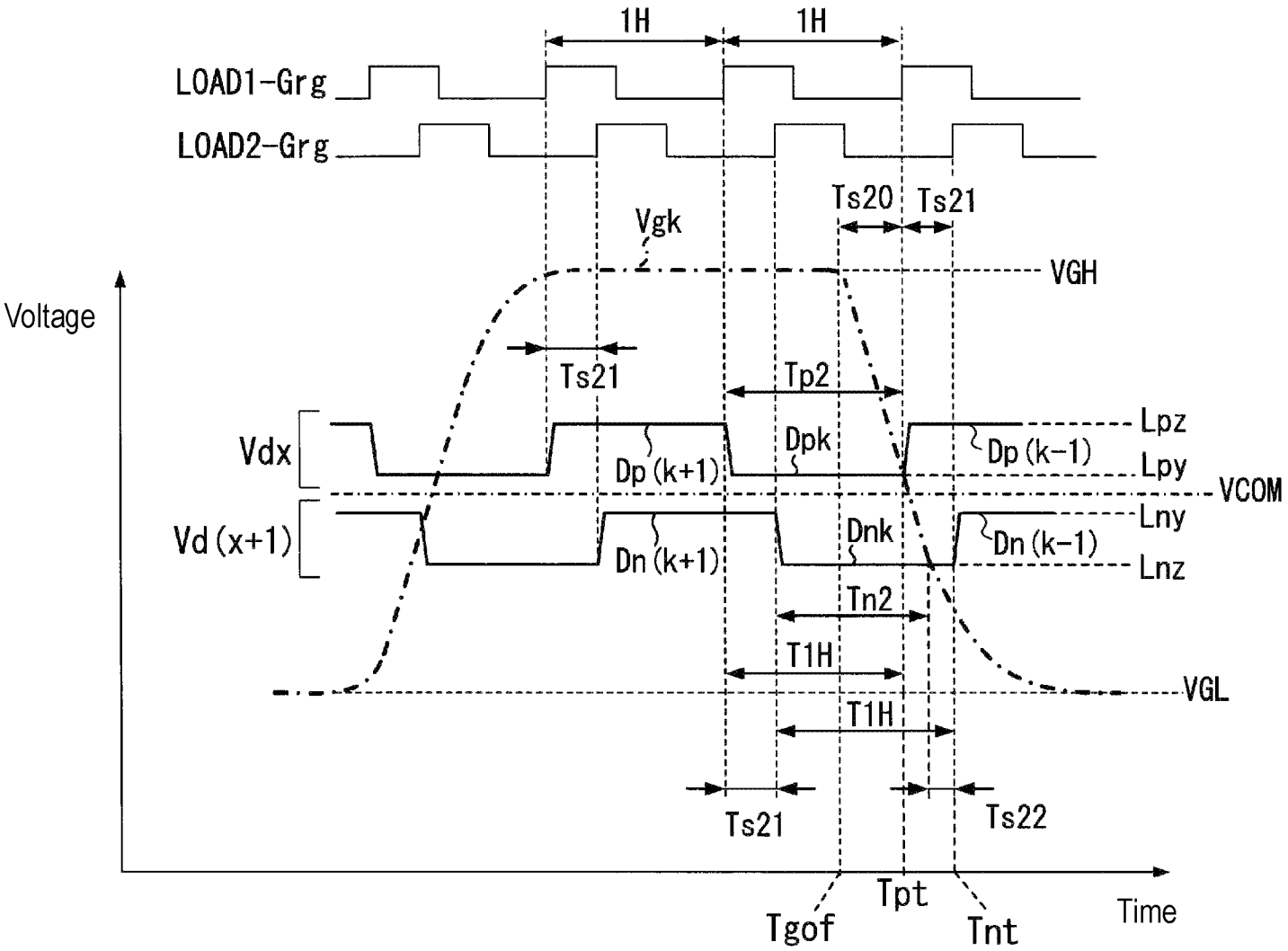
FIG. 9 is a waveform diagram showing an example of waveforms of a gate selection signal applied to a gate line and a positive and negative gradation data signal applied to a pair of data lines by the data driver 120.

FIG. 9 is a waveform diagram showing an example of waveforms of a positive gradation data signal Vdx and a negative gradation data signal Vd (x+1) applied to the adjacent data lines DLx (x is an integer of 1 to m) and DL (x+1), respectively, and a gate selection signal Vgk applied to the gate line GLk (k is an integer of 1 to r).

In addition, FIG. 9 shows a state in which the gradation data pulse Dpk included in the positive gradation data signal Vdx is supplied (charged) to the display cell 154 at the intersection of the data line DLx and the gate line GLk. Further, FIG. 9 shows a state in which the gradation data pulse Dnk included in the negative gradation data signal Vd (x+1) is supplied (charged) to the display cell 154 at the intersection of the data line DL (x+1) and the gate line GLk.

Here, the data lines DLx and DL (x+1) are data lines that intersect with the gate line GLk at a position where the wiring length from the output terminal (not shown) of the gate driver 110 on the gate line GLk is relatively long. Further, the pulse waveform of the gate selection signal Vgk shown by the one dot chain line in FIG. 9 is a waveform observed at the position of the intersection with the data lines DLx and DL (x+1) on the gate line GLk. This gate selection signal Vgk observed at the position of the intersection with the data lines DLx and DL (x+1) has a large impedance according to the wiring length of the gate line from the output terminal of the gate driver, and causes a relatively large waveform blunting.

In the example shown in FIG. 9, a state is shown in which a positive gradation data signal Vdx including a gradation data pulse Dpk is applied to the data line DLx, and a negative gradation data signal Vd (x+1) including the gradation data pulse Dnk is applied to the data line DL (x+1).

The gradation data signal has an analog voltage value (gradation voltage) supplied to each pixel in the data line direction, and is configured by a series of multiple gradation data pulses in one data period (1H) unit. Each gradation data pulse of the positive gradation data signal Vdx has a gradation voltage within the voltage range from the lower limit value Lpy to the upper limit value Lpz. Similarly, each gradation data pulse of the negative gradation data signal Vd (x+1) has a gradation voltage within the voltage range from the upper limit value Lny to the lower limit value Lnz. The facing substrate voltage VCOM is set between the lower limit value Lpy of the positive gradation data signal and the upper limit value Lny of the negative gradation data signal. In FIG. 7, for convenience of description, the gradation data pulses of the gradation data signals Vdx and Vd (x+1) indicate a drive pattern in which the gradation voltages of the upper limit value and the lower limit value within the respective voltage ranges are alternately output for each data period.

The gate selection signal Vgk shown in FIG. 9 is gate precharged in order to increase the pixel charge rate. That is, in addition to the gradation data pulses Dpk and Dnk corresponding to the pixels in the kth row, the state of high electric potential VGH is maintained including the application period of the gradation data pulses Dp (k+1) and Dn (k+1) one data period (1H) earlier corresponding to the pixel in the (k+1)th row.

In the gradation data signals Vdx and Vd (x+1) shown in FIG. 9, the positive gradation data pulse Dpk and the negative gradation data pulse Dnk are output at different timings from each other. For example, in the conventional drive shown in FIG. 1, the positive data pulse Dpk and the negative data pulse Dnk are output at the same timing, and their phases are the same.

On the other hand, in the drive shown in FIG. 9, the negative gradation data pulse Dnk is output in a phase shifted in a direction delayed by a predetermined time Ts21 with respect to the positive gradation data pulse Dpk.

The timing control of the positive gradation data signal Vdx and the gate selection signal Vgk shown in FIG. 9 will be described below.

The data driver 120 sets the output timing of the positive gradation data signal Vdx so that the gradation data pulse Dp (k−1) in the next data period of the gradation data pulse Dpk is not supplied (charged) to the display cell 154 by the gate selection signal Vgk.

That is, as shown in FIG. 9, the data driver 120 outputs the positive gradation data signal Vdx at the timing when the electric potential of the rear edge part of the gate selection signal Vgk becomes less than or equal to the lower limit value Lpy of the gradation data pulse Dpk at the time of the rear edge part of the positive gradation data pulse Dpk. For example, the control core part 510 generates the latch output timing signal LOAD1 so as to have such an output form. In this way, as shown in FIG. 9, the effective pixel charge period of the positive gradation data pulse Dpk can be set to the pixel charge period Tp2 equivalent to one data period T1H (1 horizontal scanning period 1H).

Further, as shown in FIG. 9, the data driver 120 phase-shifts the phase of the negative gradation data signal Vd (x+1) with respect to the phase of the positive gradation data signal Vdx by the time Ts21.

That is, in the configuration shown in FIG. 6, each of the image data pieces defined as the positive data by the positive data latch 710 is output at the timing corresponding to the output timing signal corresponding to each in the output timing signal group LOAD1-Grs. In addition, the negative data latch 720 outputs each of the image data pieces defined as the negative data at the timing corresponding to the output timing signal corresponding to each in the output timing signal group LOAD2-Grs, and at a timing delayed by the time Ts21 from the output timing of the positive data latch 710.

As a result, as shown in FIG. 9, the data driver 120 outputs the negative gradation data signal Vd (x+1) shifted in the direction of delaying the phase by the time Ts21 with respect to the positive gradation data signal Vdx. As a result, as shown in FIG. 9, the electric potential of the rear edge part of the gate signal Vgk becomes less than or equal to the lower limit value Lpy of the gradation data pulse Dnk at a time before the rear edge of the gradation data pulse Dnk included in the negative gradation data signal Vd (x+1).

Therefore, as shown in FIG. 9, the effective pixel charge period of the negative gradation data pulse Dnk is the pixel charge period Tn2, which is shorter than the one data period T1H by the period Ts22 (≥0). The effect of the period Ts22 is as follows.

Since the electric potential difference between the gate selection signal Vgk and the gradation data signal is larger in the negative polarity than in the positive polarity, the negative polarity has a higher pixel charge rate even in the same pixel charge period. The period Ts22 may be provided to adjust the difference between the positive and negative pixel charge rates due to the electric potential difference between the gate selection signal Vgk and the gradation data signal.

By the above-mentioned drive, a period equal to one data period T1H is secured as the effective pixel charge period Tp2 of the positive gradation data pulse Dpk, and the effective pixel charge period Tn2 of the negative electrode gradation data pulse Dnk can be set to one data period T1H or less.

Figure 1:
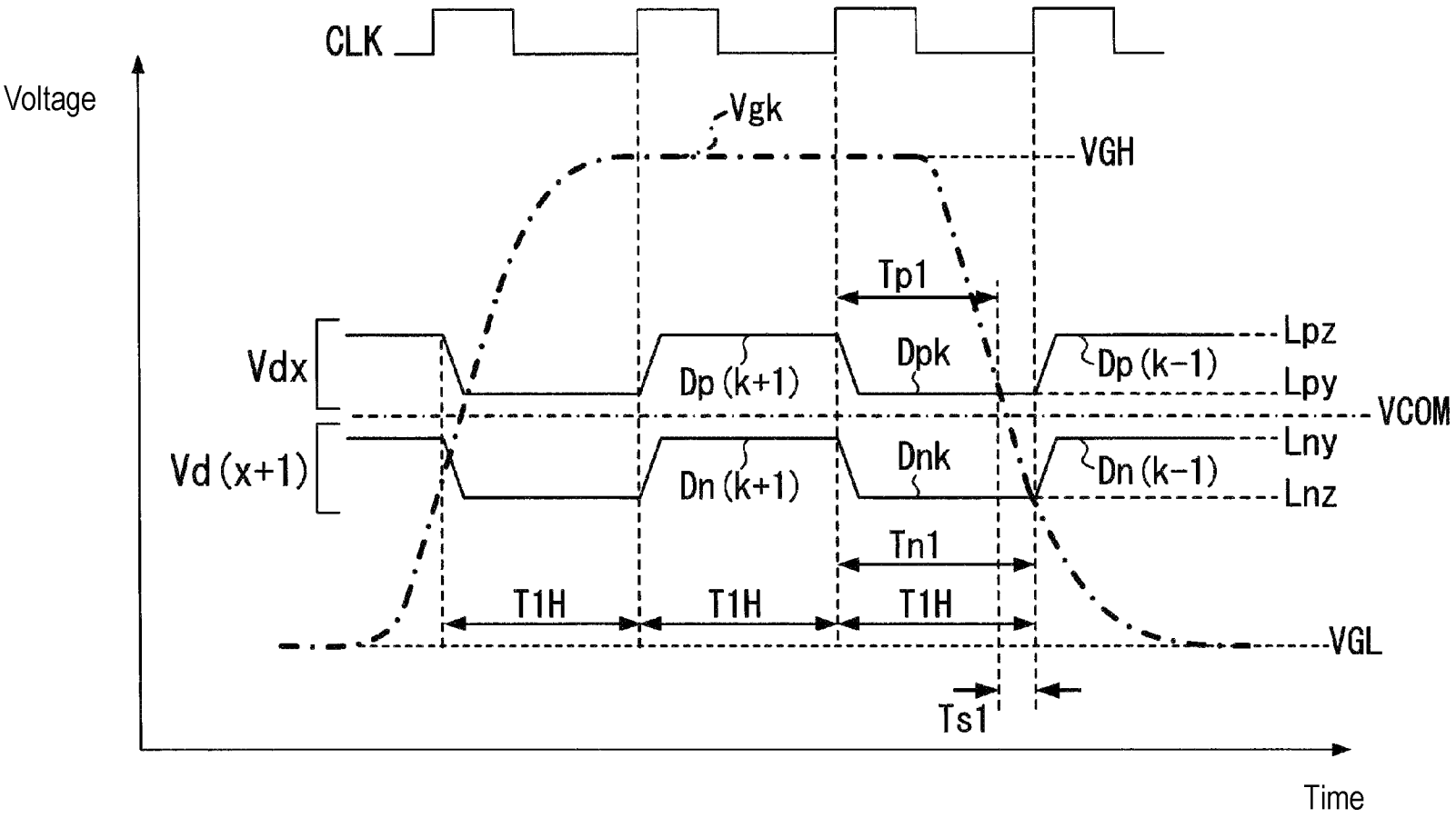
FIG. 1 is a waveform diagram showing a waveform example of a gate selection signal applied to a gate line and a positive and negative gradation data signal applied to a pair of adjacent data lines by conventional driving.

Therefore, the pixel charge period Tp2 of the positive gradation data pulse Dpk is longer than the pixel charge period Tp1 shown in FIG. 1, and the pixel charge period Tn2 of the negative gradation data pulse Dnk can be set to be less than or equal to the pixel charge period Tn1 shown in FIG. 1.

In this way, the pixel charge rate due to the negative gradation data signal is lowered and adjusted, while the pixel charge rate due to the positive gradation data signal is increased, whereby the difference between the pixel charge rate due to the negative gradation data signal and the pixel charge rate due to the positive gradation data signal is reduced.

Therefore, according to the data driver 120, even if blunting occurs in the pulse edge part of the gate selection signal, it is possible to suppress flicker and image quality deterioration caused by the difference between the pixel charge rate due to the negative gradation data signal and the pixel charge rate due to the positive gradation data signal.

Further, in the data driver 120, the slew rate control part 510*a* and the positive bias generation part 61 control the slew rate of the output amplifier which is responsible for the output of the positive gradation data signal as follows.

That is, the slew rate of the output amplifier responsible for the output of the positive gradation data signal is controlled by the slew rate control part 510*a* and the positive bias generation part 61 so that it is lower than the slew rate of the output amplifier responsible for the output of the negative gradation data signal.

Figure 2:
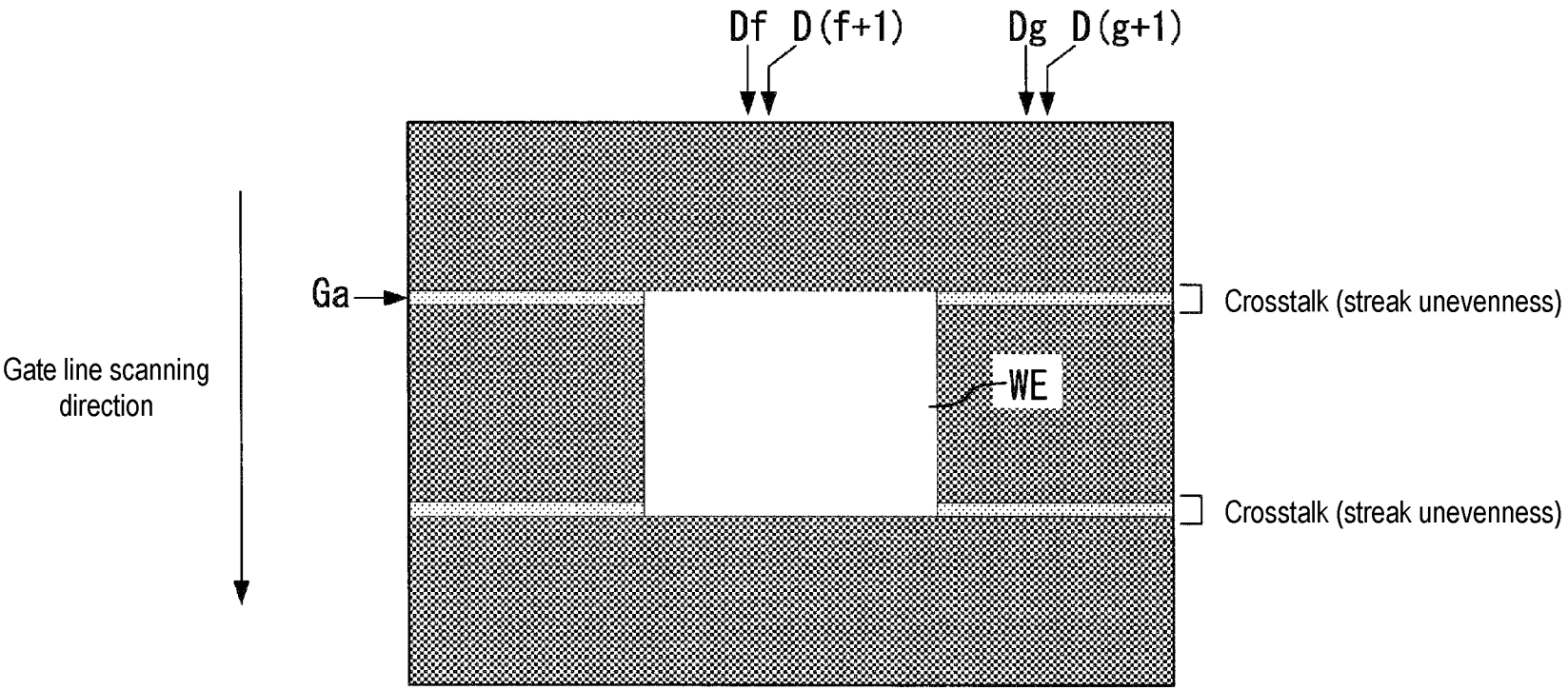
FIG. 2 is a diagram showing an example of crosstalk (streak unevenness) that appears in an image including a white square area in the center of the screen on a gray background when the image is displayed.
Figure 3:
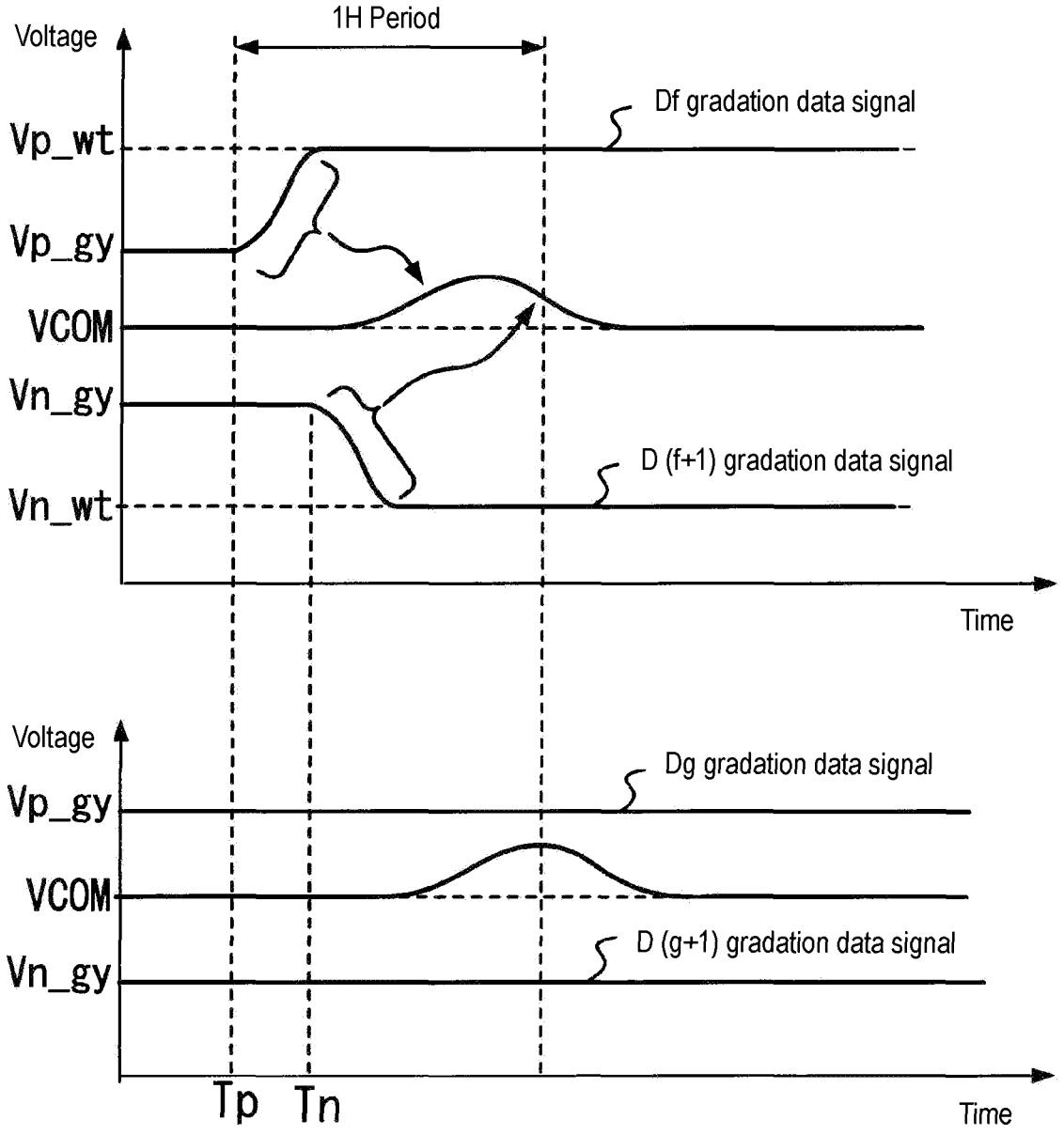
FIG. 3 is a waveform diagram showing a waveform of a gradation data signal group applied to a pair of data lines passing through the white square area and a pair of data lines not passing through the white square area, and a waveform of a facing substrate voltage, in order to display the image including the white square area in the center of the screen on a gray background.

As a result, it is possible to reduce the peak of the fluctuation of the facing substrate voltage VCOM that occurs when a specific image as shown in FIG. 2 is displayed.

In the slew rate control part 510*a* and the positive bias generation part 61, the larger the phase difference (Ts21)

between the positive gradation data signal and the negative gradation data signal, the larger the decrease in the slew rate of the output amplifier responsible for the output of the positive gradation data signal, so that the fluctuation of the facing substrate voltage VCOM can be suppressed.

Figure 10:
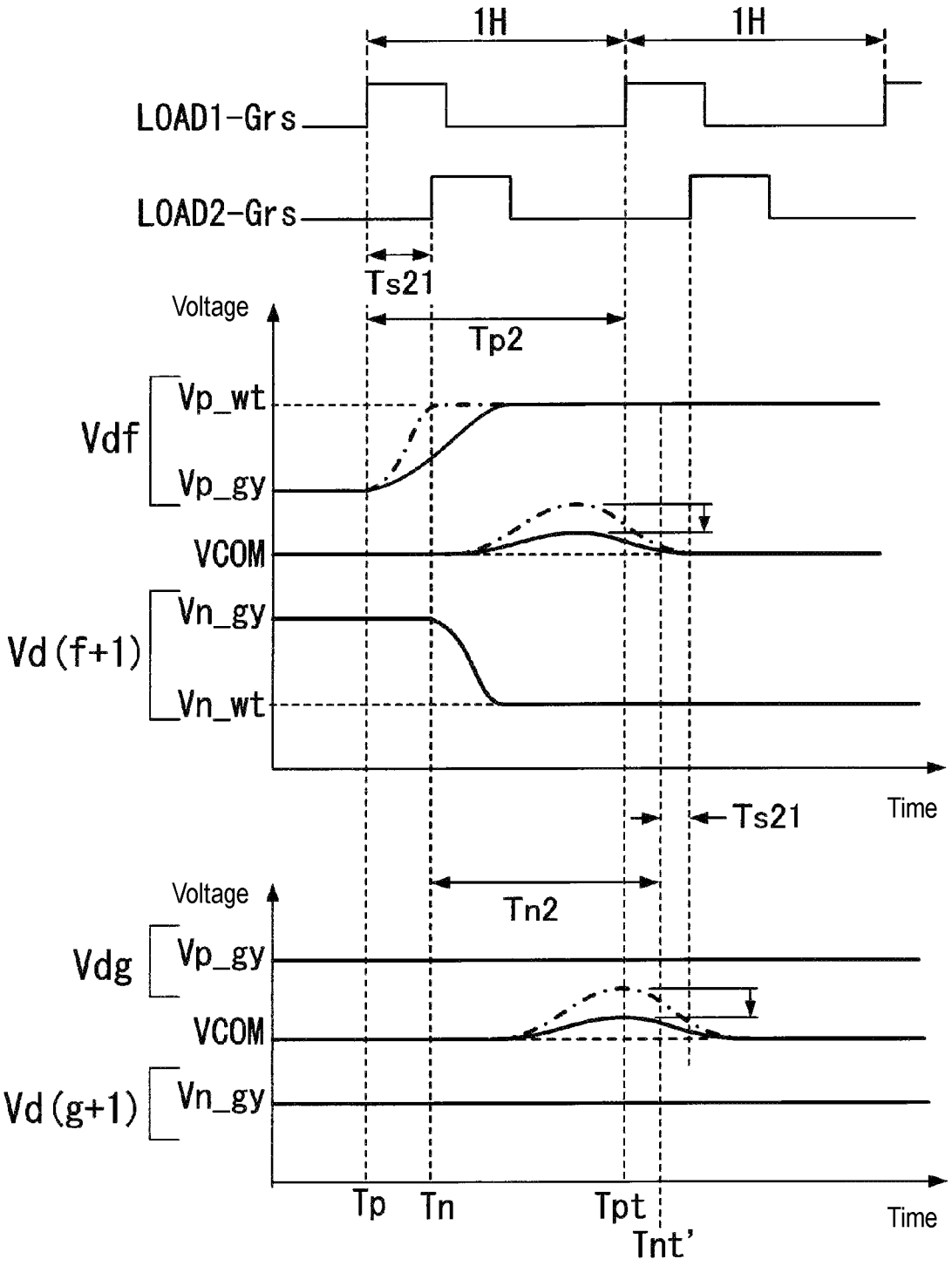
FIG. 10 is a waveform diagram showing waveforms of a gradation data signal group applied by the data driver 120 to a pair of data lines passing through the white square area shown in FIG. 2 and a pair of data lines not passing through the white square area, and a waveform of the facing substrate voltage.

FIG. 10 is a waveform diagram showing waveforms of the gradation data signals Vdf, Vd (f+1), Vdg and Vd (g+1) transmitted to the data lines Df and D (f+1) passing through the white square area WE shown in FIG. 2 and the data lines Dg and D (g+1) not passing through the white square area WE, respectively, and a waveform of the facing substrate voltage VCOM.

As shown in FIG. 10, in the data line D (f+1), the level of the negative gradation data signal Vd (f+1) decreases from the level Vn_gy representing gray to the level Vn_wt representing white at the time point Tn.

In addition, in the data line Df, the level of the positive gradation data signal Vdf increases from the level Vp_gy representing gray to the level Vp_wt representing white at the time point Tp before the time point Tn by the time Ts21. However, the slew rate of the output amplifier that outputs the positive gradation data signal Vdf is controlled to be lower than the slew rate of the output amplifier that outputs the negative gradation data signal Vd (f+1), corresponding to the time Ts21. The rate of decrease in slew rate depends on the length of the time Ts21, but the slew rate (absolute value of the amount of voltage change per unit time) of the output amplifier that outputs the positive gradation data signal is decreased by, for example, 20% to 50% with respect to the slew rate (absolute value of the amount of voltage change per unit time) of the output amplifier that outputs the negative gradation data signal. As a result, it is desirable to suppress the fluctuation of the facing substrate voltage VCOM from the expected value to a level where crosstalk (streak unevenness) cannot be visually recognized.

Therefore, as shown in FIG. 10, the voltage of the rising waveform of the positive gradation data signal Vdf changes more slowly than the rising waveform (indicated by the one dot chain line) in the case where such lowering control of the slew rate is not performed.

As a result, as shown in FIG. 10, the peak voltage of the fluctuation of the facing substrate voltage VCOM due to the capacitive coupling between the data line Df and the facing substrate electrode C3 becomes lower than the peak voltage of the fluctuation (indicated by the one dot chain line) of the facing substrate voltage VCOM when the above-mentioned slew rate lowering control is not performed. Regarding the data lines Dg and D (g+1) that do not pass through the white square area WE shown in FIG. 2, with reference to FIG. 10, in the pixel selected by the gate line Ga and to which the positive gradation data signal of the data line Dg is supplied, the effective pixel charge period is the period Tp2, and the voltage difference between the gradation data signal and the facing substrate voltage VCOM at the time Tpt is maintained for one frame period and applied to the liquid crystal of the pixel. As shown in FIG. 10, since the fluctuation of the facing substrate voltage VCOM is reduced, the voltage applied to the liquid crystal of the pixel is also suppressed from decreasing from the expected value, and the decrease in brightness is also suppressed. Further, in the pixel to which the negative gradation data signal of the data line D (g+1) is supplied, the effective pixel charge period is the period Tn2, and the voltage difference between the gradation data signal and the facing substrate voltage VCOM at the time Tnt' is maintained for one frame period and applied to the liquid crystal of the pixel. As shown in FIG. 10, since the fluctuation of the facing substrate voltage VCOM is reduced, the voltage applied to the liquid crystal display of the pixel is also suppressed from increasing from the expected value, and the increase in brightness is also suppressed. By suppressing the change in the brightness of these pixels to less than a certain level, the brightness of each of the positive and negative pixels is almost offset, and the difference in brightness from the surroundings becomes unlikely to be visually recognized.

Therefore, it is possible to suppress crosstalk (streak unevenness) that occurs at the boundary between the gray background and the white square area WE as shown in FIG. 2 due to the fluctuation of the facing substrate voltage VCOM.

As described above, the liquid crystal display device 20 adopts something that includes a control part as described below a slew rate setting part as the data driver 120 that performs column inversion drive for switching the polarity of the gradation data signal output to each data line of the display panel 150 for each frame period.

That is, the control part (510, 510*a*) shifts the phase of the negative gradation data signal in the direction delayed with respect to the positive gradation data signal output to each data line of the display panel. As a result, even in a state where blunting occurs at the rear edge part of the gate selection signal, the difference between the pixel charge rate due to the negative gradation data signal and the pixel charge rate due to the positive gradation data signal is reduced. Therefore, it is possible to suppress flicker caused by the difference between the pixel charge rate due to the negative gradation data signal and the pixel charge rate due to the positive gradation data signal.

The slew rate setting part (60, 62) lowers the slew rate of the output amplifier responsible for the output of the positive gradation data signal from the slew rate of the output amplifier which outputs the negative gradation data signal, corresponding to the phase difference between the positive gradation data signal and the negative gradation data signal. As a result, the peak of the fluctuation of the facing substrate voltage due to the capacitive coupling between the data line and the facing substrate electrode, which is caused by delaying the phase of the negative gradation data signal with respect to the positive gradation data signal, is reduced, and it is possible to suppress the crosstalk (streak unevenness) that appears in the display image due to the fluctuation of the facing substrate voltage.

Therefore, according to the liquid crystal display device 10 as the display device according to the disclosure, in a large screen and high-definition liquid crystal display panel in which blunting occurs in the rear edge part of the gate selection signal when the display panel is driven by column drive, it is possible to display an image while suppressing image quality deterioration such as flicker and crosstalk (streak unevenness).

In the embodiment shown in FIG. 6, the slew rate setting part 60 generates the bias currents of the i output amplifiers included in the output amplifier part 95 by a single negative bias generation part 61 and a single positive bias generation part 62, respectively. However, the i output amplifiers may be divided into U (U is an integer of 2 or more) groups, and a dedicated negative bias generation part 61 and positive bias generation part 62 may be provided for each group. That is, the slew rate setting part 60 may have any configuration in which the slew rate is set by a single or multiple bias generation parts (61, 62) for multiple output amplifiers. Therefore, the setting of the slew rate of the output amplifier responsible for the output of the positive gradation data signal and the slew rate of the output amplifier responsible for the output of the negative gradation data signal, for example, can be adjusted individually for each data driver or for each group of output amplifiers controlled by multiple bias generation parts in the data driver according to the phase difference between the positive gradation data signal and the negative gradation data signal.

In short, the display device (10) according to the disclosure may include the following display panel, gate driver, and data driver.

That is, the display panel (150) has multiple data lines (DL1 to DLm) configured by the first and second data line groups, multiple gate lines (GL1 to GLr) disposed intersecting with the multiple data lines, and display cells (154) as pixels disposed at each intersection of the data line and the gate line. The gate driver (110) supplies a gate selection signal to each of the multiple gate lines of the display panel.

The data driver (120) is provided for each predetermined number of data lines (i lines) on the display panel, and each generates a positive gradation data signal (Vdx) and a negative gradation data signal (Vd (x+1)) with respect to a predetermined reference voltage (VCOM) based on the image signal (DVS). Specifically, the data driver generates a signal as the positive gradation data signal described above in which a data pulse (Dpk) having a positive voltage value corresponding to the brightness level of each pixel based on the image signal appears in a predetermined period (1H, T1H). Further, the data driver generates a signal as the negative gradation data signal described above in which the data pulse (Dnk) having a negative voltage value corresponding to the brightness level of each pixel based on the image signal appears at every predetermined cycle in a phase shifted in a direction delayed with respect to the phase of the positive gradation data signal. Then, the data driver outputs one of the positive gradation data signal and the negative gradation data signal to the data line group of one of the first and second data line groups, and also outputs the other of the positive gradation data signal and the negative gradation data signal to the other data line group of the first and second data line groups.

The data driver includes multiple output amplifiers (95) that individually output the positive gradation data signal and the negative gradation data signal. The data driver controls the slew rate of the output amplifier responsible for the output of the positive gradation data signal to be lower than the slew rate of the output amplifier responsible for the output of the negative gradation data signal, according to the phase difference (Ts21) between the positive gradation data signal and the negative gradation data signal (510*a*, 62).

Next, the detailed configuration of the output amplifier part 95 will be described.

Figure 11:
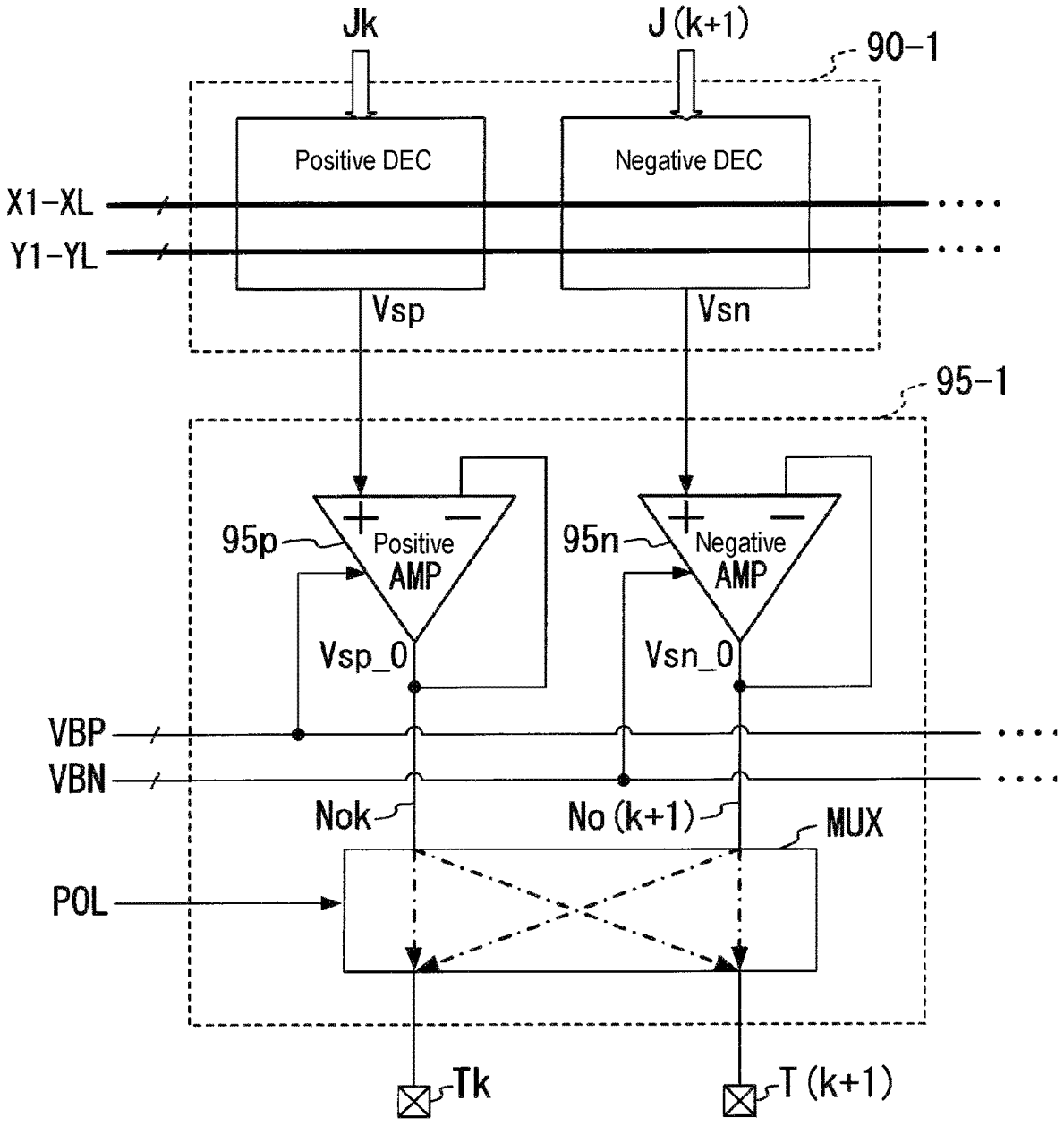
FIG. 11 is a block diagram showing an example of a partial configuration in the output amplifier part 95.

FIG. 11 is a block diagram showing an example of the internal configuration of the output amplifier corresponding to each output channel included in the output amplifier part 95. Specifically, FIG. 11 shows a configuration example in the case where dedicated positive and negative output amplifiers are adopted as each output amplifier.

In FIG. 11, from the output amplifier part 95, a pair of output amplifiers (95*p*, 95*n*) that output positive and gradation negative data signals (Vsp_O, Vsn_O), respectively, and a multiplexer that alternately switches and supplies the outputs of the pair of output amplifiers to external terminals Tk and T (k+1) are taken and shown as an output amplifier part 95-1. Further, in FIG. 11, from the decoder part 90, a pair of positive decoder and negative decoder that supply positive and negative gradation voltages (Vsp, Vsn) to the pair of output amplifiers (95*p*, 95*n*), respectively, are taken and shown as a decoder part 90-1.

In FIG. 11, the negative output amplifier 95*n* is a voltage follower whose output terminal is connected to the inverting input terminal, and generates a gradation data signal Vsn_O obtained by amplifying the negative gradation voltage Vsn received by its non-inverting input terminal, and supplies this to a multiplexer MUX via a node No (k+1).

The positive output amplifier 95*p* is a voltage follower whose output terminal is connected to the inverting input terminal, and generates a gradation data signal Vsp_O obtained by amplifying the positive gradation voltage Vsp received by its non-inverting input terminal, and supplies this to the multiplexer MUX via a node Nok. At this time, the slew rate when the positive output amplifier 95*p* outputs the gradation data signal Vsp_O according to the bias voltage group VBP described above is lowered from the slew rate when the negative output amplifier 95*n* outputs the gradation data signal Vsn_O.

When the polarity inversion signal POL represents one of the logic levels 1 and 0, the multiplexer MUX outputs the positive gradation data signal Vsp_O as the gradation data signal Vdk via the external terminal Tk (k is an integer of 2 or more), and outputs the negative gradation data signal Vsn_O as the gradation data signal Vd (k+1) via the external terminal T (k+1). Further, when the polarity inversion signal POL represents the other of logic levels 1 and 0, the multiplexer MUX outputs the negative gradation data signal Vsn_O as the gradation data signal Vdk via the external terminal Tk, and outputs the positive gradation data signal Vsp_O as the gradation data signal Vd (k+1) via the external terminal T (k+1).

Figure 12:
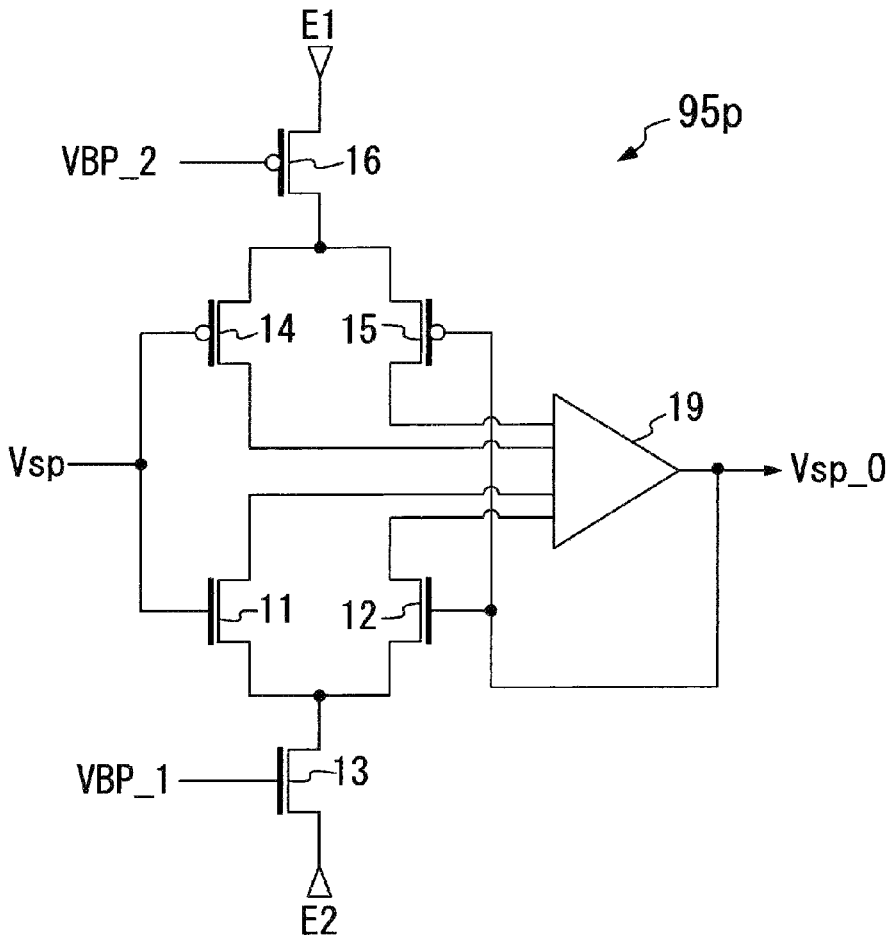
FIG. 12 is a circuit diagram showing an example of a circuit configuration of each output amplifier by taking out a positive output amplifier from the output amplifier group included in the output amplifier part 95.

FIG. 12 is a circuit diagram showing an example of a circuit configuration of each output amplifier included in the output amplifier part 95 by taking out the positive output amplifier 95*p* from the output amplifiers 95*p* and 95*n*.

As shown in FIG. 12, the output amplifier 95*p* includes a differential stage including N-channel MOS type transistors 11 to 13 and P-channel MOS type transistors 14 to 16, and an amplification stage 19.

The transistors 11 and 12 form an N-type differential pair. The transistor 11 receives the positive gradation voltage Vsp at its own gate, and the transistor 12 receives the positive gradation data signal Vsp_O which is the output of the output amplifier 95*p* at its own gate. The sources of the transistors 11 and 12 are connected to each other, and the drains of the transistors 11 and 12 are connected to the amplification stage 19. The transistor 13 as a current source of the N-type differential pair receives the first bias voltage VBP_1 of the bias voltage group VBP generated by the positive bias generation part 62 at its own gate. A predetermined low power supply electric potential E2 is applied to the source of the transistor 13, and the drain is connected to the sources of the transistors 11 and 12.

With this configuration, the N-type differential pair (11, 12) draws a pair of currents having a current ratio corresponding to the difference between the positive gradation voltage Vsp and the gradation data signal Vsp_O from the amplification stage 19 as a differential output current pair on a negative side. The total current of the differential output current pair on the negative side is the amount of current output by the transistor 13 based on the first bias voltage VBP_1.

The transistors 14 and 15 form a P-type differential pair. The transistor 14 receives the positive gradation voltage Vsp at its own gate, and the transistor 15 receives the positive gradation data signal Vsp_O which is the output of the output amplifier 95*p* at its own gate. The sources of the transistors 14 and 15 are connected to each other, and the drains of the transistors 14 and 15 are connected to the amplification stage 19. The transistor 16 as a current source of the P-type differential pair receives the second bias voltage VBP_2 of the bias voltage group VBP generated by the positive bias generation part 62 at its own gate. A predetermined high power supply electric potential E1 is applied to the source of the transistor 16, and the drain is connected to the sources of the transistors 14 and 15.

With this configuration, the P-type differential pair (14, 15) transmits a pair of currents having a current ratio corresponding to the difference between the positive gradation voltage Vsp and the gradation data signal Vsp_O to the amplification stage 19 as a differential output current pair on a positive side. The total current of the differential output current pair on the positive side is the amount of current output by the transistor 16 based on the second bias voltage VBP_2.

The amplification stage 19 transmits a current corresponding to the differential output current pair on the positive side to the output terminal and draws a current corresponding to the differential output current pair on the negative side from the output terminal to generate a positive gradation data signal Vsp_O corresponding to the positive gradation voltage Vsp and outputs it via the output terminal. The amplification stage 19 receives a third bias voltage VBP_3 (not shown) required for its own amplification operation among the bias voltage group VBP generated by the positive bias generation part 62.

According to the configuration shown in FIG. 12, the positive output amplifier 95*p* outputs the gradation data signal Vsp_O at a slew rate corresponding to VBP_1, VBP_2, and VBP_3 as the bias voltage group VBP. The bias voltages VBP_1, VBP_2, and VBP_3 are variably controlled according to the slew rate control signal SRL transmitted from the slew rate control part 510*a*. At this time, as described above, the slew rate control signal SRL is responsible for the control of lowering the slew rate of the output amplifier 95*p* according to the phase difference between the latch output timing signal LOAD1 and the latch output timing signal LOAD2. Here, in order to reduce the slew rate of the positive output amplifier 95*p*, the voltage values of the bias voltages VBP_1 and VBP_2 are set at least in the direction in which the current transmitted by the transistors 13 and 16 as current sources becomes smaller.

In FIG. 12, a complementary differential configuration including the N-type differential stage (11 to 13) and the P-type differential stage (14 to 16) is provided, but a configuration having only one of the differential stages may be used. Further, the same circuit as in FIG. 12 may be adopted for the negative output amplifier 95*n* shown in FIG. 11. However, the first to third bias voltages VBN_1 to VBN_3 received by the negative output amplifier 95*n* may each have a predetermined fixed value, or the slew rate may be adjusted at the same ratio in conjunction with the positive output amplifier 95*p*. When the negative output amplifier 95*n* and the positive output amplifier 95*p* are controlled in conjunction with each other, it is preferable that the negative output amplifier 95*n* is controlled by a control signal different from the slew rate control signal SRL.

Figure 13:
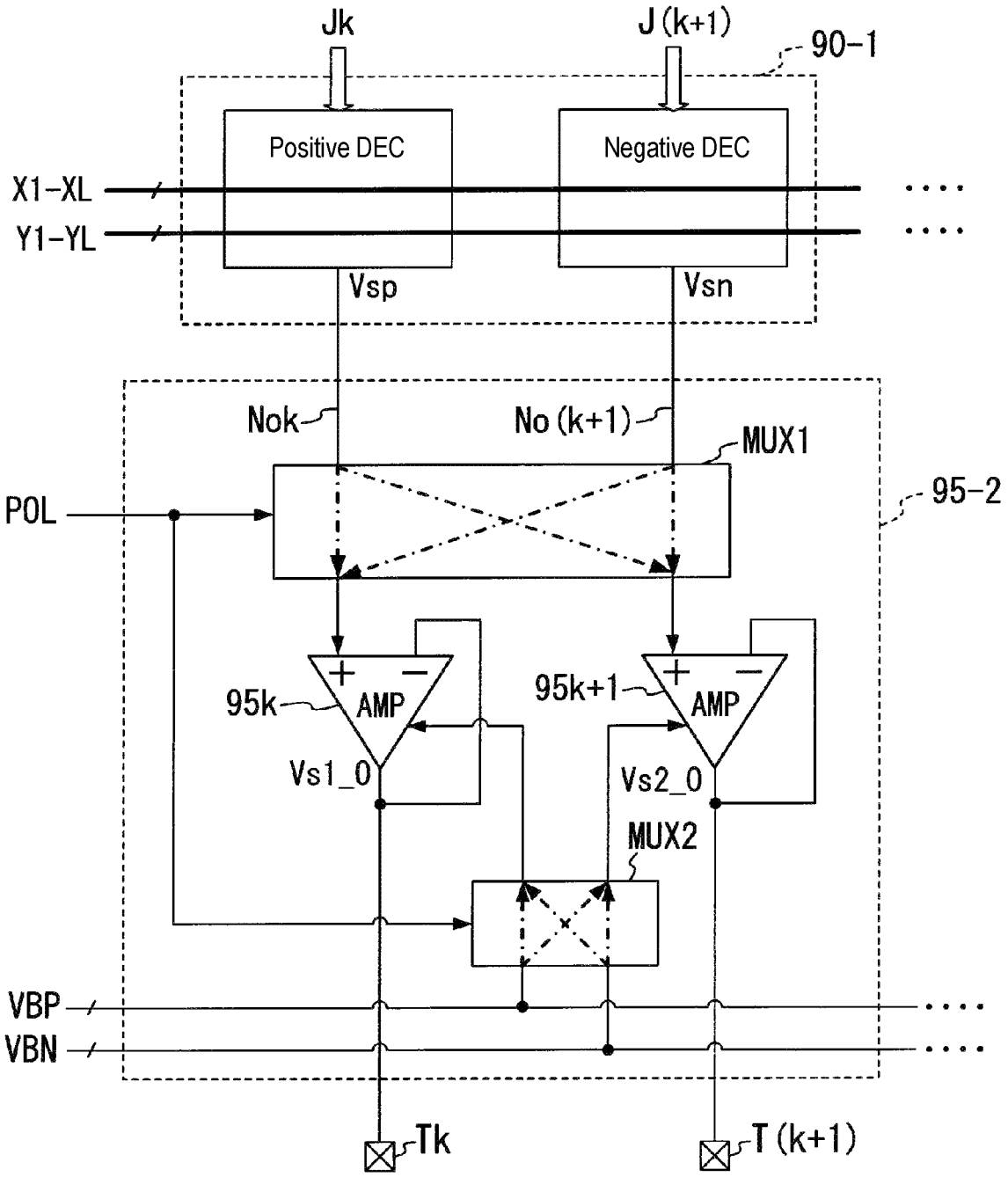
FIG. 13 is a block diagram showing another example of a partial configuration in the output amplifier part 95.

FIG. 13 is a block diagram showing another example of the internal configuration of the output amplifier corresponding to each output channel included in the output amplifier part 95.

In FIG. 13, from the output amplifier part 95, a pair of adjacent output amplifiers (95*k*, 95*k*+1), and first and second multiplexers (MUX1, MUX2) provided corresponding to the pair of output amplifiers are taken and shown as an output amplifier part 95-2. Further, in FIG. 13, from the decoder part 90, a pair of positive decoder and negative decoder that supply positive and negative gradation voltages (Vsp, Vsn) to the output amplifier 95-2 are taken and shown as a decoder part 90-1.

In FIG. 13, the multiplexer MUX1 receives the polarity inversion signal POL transmitted from the control core part 510. When the polarity inversion signal POL represents one of the logic levels 1 and 0, the multiplexer MUX1 supplies a positive gradation voltage Vsp to the non-inverting input terminal of the output amplifier 95*k*, and supplies a negative gradation voltage Vsn to the non-inverting input terminal of the output amplifier 95*k*+1. Further, when the polarity inversion signal POL represents the other of logic levels 1 and 0, the multiplexer MUX1 supplies a negative gradation voltage Vsn to the non-inverting input terminal of the output amplifier 95*k*, and supplies a positive gradation voltage Vsp to the non-inverting input terminal of the output amplifier 95*k*+1.

The output amplifier 95*k* is a voltage follower whose output terminal is connected to the inverting input terminal, and generates a gradation data signal Vs1_O obtained by amplifying the gradation voltage received by its non-inverting input terminal, and outputs this as a gradation data signal Vdk via the external terminal Tk.

The output amplifier 95*k*+1 is a voltage follower whose output terminal is connected to the inverting input terminal, and generates a gradation data signal Vs2_O obtained by amplifying the gradation voltage received by its non-inverting input terminal, and outputs this as a gradation data signal Vd (k+1) via the external terminal T (k+1).

The multiplexer MUX2 receives the polarity inversion signal POL transmitted from the control core part 510. When the polarity inversion signal POL represents one of the logic levels 1 and 0, the multiplexer MUX2 supplies the bias voltage group VBP to the output amplifier 95*k* and supplies the bias voltage group VBN to the output amplifier 95*k*+1. Further, when the polarity inversion signal POL represents the other of the logic levels 1 and 0, the multiplexer MUX2 supplies the bias voltage group VBN to the output amplifier 95*k* and supplies the bias voltage group VBP to the output amplifier 95*k*+1. That is, when the output amplifier part 95 adopts a configuration in which the polarity of the gradation voltage received by each output amplifier (95*k*, 95*k*+1) is switched according to the polarity inversion signal POL, as shown in FIG. 13, the polarity of the bias voltage received by the output amplifier is also switched according to the polarity inversion signal POL by the multiplexer MUX2. The output amplifier 95*k* and the output amplifier 95*k*+1 may also adopt the same configuration as in FIG. 12, and may control the slew rate to be lowered when the positive gradation voltage Vsp is supplied.

What is claimed is:

1. A display device, comprising:

a display panel which comprises a plurality of data lines including a first data line group and a second data line group, a plurality of gate lines disposed intersecting with the data lines, and display cells as pixels disposed at each intersection of the data lines and the gate lines;

a gate driver which supplies a gate selection signal to each of the gate lines; and a plurality of data drivers provided for each predetermined number of data lines, wherein each data driver receives an image signal and generates, based on the image signal, a positive gradation data signal higher than a predetermined reference voltage and a negative gradation data signal lower than the predetermined reference voltage, outputs one of the positive gradation data signal and the negative gradation data signal to one data line group of the first data line group and the second data line group, and outputs the other of the positive gradation data signal and the negative gradation data signal to the other data line group of the first data line group and the second data line group, wherein the data driver:

comprises a plurality of output amplifiers, wherein each output amplifier outputs one of the positive gradation data signal and the negative gradation data signal;

generates a signal as the positive gradation data signal in which a data pulse having a positive voltage value corresponding to a brightness level of each pixel based on the image signal appears in a predetermined cycle, and generates a signal as the negative gradation data signal in which a data pulse having a negative voltage value corresponding to the brightness level of each pixel based on the image signal appears at every predetermined cycle in a phase shifted in a direction delayed with respect to a phase of the positive gradation data signal; and controls a slew rate of an output amplifier responsible for an output of the positive gradation data signal among the output amplifiers to be lower than a slew rate of an output amplifier responsible for an output of the negative gradation data signal.

2. The display device according to claim 1, wherein the display cell comprises:

a liquid crystal layer;

a pixel electrode and an another electrode that apply an electric field to the liquid crystal layer; and a pixel switch that turns on when the gate selection signal is supplied to the gate line and supplies the gradation data signal supplied to the data line to the pixel electrode, wherein the reference voltage is applied to the another electrode.

3. The display device according to claim 2, further comprising:

a slew rate control part which generates a slew rate control signal that indicates to lower the slew rate of the output amplifier responsible for the output of the positive gradation data signal by an amount corresponding to a phase difference between the positive gradation data signal and the negative gradation data signal;

a first bias generation part which generates a first bias voltage for the output amplifier responsible for the output of the positive gradation data signal according to the slew rate control signal, wherein the first bias voltage sets a current amount of a bias current flowing in the output amplifier in order to operate the output amplifier; and a second bias generation part which generates a second bias voltage for the output amplifier responsible for the output of the negative gradation data signal, wherein the second bias voltage sets a bias current of a predetermined current amount flowing in the output amplifier in order to operate the output amplifier, wherein the output amplifier responsible for the output of the positive gradation data signal receives the first bias voltage and outputs an output current for generating the gradation data signal based on a bias current corresponding to the first bias voltage, and the output amplifier responsible for the output of the negative gradation data signal receives the second bias voltage and outputs an output current for generating the gradation data signal based on a bias current corresponding to the second bias voltage.

4. The display device according to claim 3, wherein the data driver comprises a decoder part that converts the brightness level of each pixel based on the image signal into a positive gradation voltage having a positive voltage value or a negative gradation voltage having a negative voltage value, wherein the output amplifier responsible for the output of the positive gradation data signal among the output amplifiers is an operational amplifier which receives the positive gradation voltage at its own non-inverting input terminal, and its own inverting input terminal and output terminal are connected to each other, and the output amplifier responsible for the output of the negative gradation data signal among the output amplifiers is an operational amplifier which receives the negative gradation voltage at its own non-inverting input terminal, and its own inverting input terminal and output terminal are connected to each other.

5. The display device according to claim 4, further comprising a multiplexer that alternately switches between a first state and a second state for each frame period of the image signal, wherein in the first state, the output terminal of the output amplifier responsible for the output of the positive gradation data signal is connected to one external terminal of a plurality of external terminals of the data drivers, and the output terminal of the output amplifier responsible for the output of the negative gradation data signal is connected to another external terminal; and in the second state, the output terminal of the output amplifier responsible for the output of the positive gradation data signal is connected to the another external terminal, and the output terminal of the output amplifier responsible for the output of the negative gradation data signal is connected to the one external terminal.

6. The display device according to claim 5, wherein the output amplifier comprises:

a differential pair including a first transistor that receives the positive gradation voltage or the negative gradation voltage at its gate, and a second transistor that receives the gradation data signal output by the output amplifier itself at its gate;

a current source that generates a bias current corresponding to the bias voltage and supplies it to sources of the first and second transistors; and an amplification stage that generates the gradation data signal on the output terminal by flowing a current corresponding to a pair of differential output currents flowing through the differential pair to the output terminal.

7. The display device according to claim 4, wherein the output amplifier comprises:

a differential pair including a first transistor that receives the positive gradation voltage or the negative gradation voltage at its gate, and a second transistor that receives the gradation data signal output by the output amplifier itself at its gate;

a current source that generates a bias current corresponding to the bias voltage and supplies it to sources of the first and second transistors; and an amplification stage that generates the gradation data signal on the output terminal by flowing a current corresponding to a pair of differential output currents flowing through the differential pair to the output terminal.

8. The display device according to claim 3, wherein the data driver comprises:

a decoder part that converts the brightness level of each pixel based on the image signal into a positive gradation voltage having a positive voltage value or a negative gradation voltage having a negative voltage value;

a first multiplexer that alternately switches between a first state and a second state for each frame period of the image signal, wherein in the first state, the positive gradation voltage is supplied to one output operational amplifier among the output amplifiers, and the negative gradation voltage is supplied to another output operational amplifier among the output amplifiers; and in the second state, the positive gradation voltage is supplied to the another output operational amplifier, and the negative gradation voltage is supplied to the one output operational amplifier; and a second multiplexer that alternately switches, for each frame period of the image signal, between a state in which the first bias voltage is supplied to the one output operational amplifier and the second bias voltage is supplied to the another output operational amplifier, and a state in which the first bias voltage is supplied to the another output operational amplifier and the second bias voltage is supplied to the one output operational amplifier, wherein the one output operational amplifier is an operational amplifier which receives the positive gradation voltage or the negative gradation voltage at its own non-inverting input terminal, and its own inverting input terminal and output terminal are connected to one external terminal among a plurality of external terminals of the data drivers, and the another output operational amplifier is an operational amplifier which receives the negative gradation voltage or the positive gradation voltage at its own non-inverting input terminal, and its own inverting input terminal and output terminal are connected to another external terminal among the external terminals of the data drivers.

9. The display device according to claim 1, further comprising:

a slew rate control part which generates a slew rate control signal that indicates to lower the slew rate of the output amplifier responsible for the output of the positive gradation data signal by an amount corresponding to a phase difference between the positive gradation data signal and the negative gradation data signal;

a first bias generation part which generates a first bias voltage for the output amplifier responsible for the output of the positive gradation data signal according to the slew rate control signal, wherein the first bias voltage sets a current amount of a bias current flowing in the output amplifier in order to operate the output amplifier; and a second bias generation part which generates a second bias voltage for the output amplifier responsible for the output of the negative gradation data signal, wherein the second bias voltage sets a bias current of a predetermined current amount flowing in the output amplifier in order to operate the output amplifier, wherein the output amplifier responsible for the output of the positive gradation data signal receives the first bias voltage and outputs an output current for generating the gradation data signal based on a bias current corresponding to the first bias voltage, and the output amplifier responsible for the output of the negative gradation data signal receives the second bias voltage and outputs an output current for generating the gradation data signal based on a bias current corresponding to the second bias voltage.

10. The display device according to claim 9, wherein the data driver comprises a decoder part that converts the brightness level of each pixel based on the image signal into a positive gradation voltage having a positive voltage value or a negative gradation voltage having a negative voltage value, wherein the output amplifier responsible for the output of the positive gradation data signal among the output amplifiers is an operational amplifier which receives the positive gradation voltage at its own non-inverting input terminal, and its own inverting input terminal and output terminal are connected to each other, and the output amplifier responsible for the output of the negative gradation data signal among the output amplifiers is an operational amplifier which receives the negative gradation voltage at its own non-inverting input terminal, and its own inverting input terminal and output terminal are connected to each other.

11. The display device according to claim 10, further comprising a multiplexer that alternately switches between a first state and a second state for each frame period of the image signal, wherein in the first state, the output terminal of the output amplifier responsible for the output of the positive gradation data signal is connected to one external terminal of a plurality of external terminals of the data drivers, and the output terminal of the output amplifier responsible for the output of the negative gradation data signal is connected to another external terminal; and in the second state, the output terminal of the output amplifier responsible for the output of the positive gradation data signal is connected to the another external terminal, and the output terminal of the output amplifier responsible for the output of the negative gradation data signal is connected to the one external terminal.

12. The display device according to claim 11, wherein the output amplifier comprises:

a differential pair including a first transistor that receives the positive gradation voltage or the negative gradation voltage at its gate, and a second transistor that receives the gradation data signal output by the output amplifier itself at its gate;

a current source that generates a bias current corresponding to the bias voltage and supplies it to sources of the first and second transistors; and an amplification stage that generates the gradation data signal on the output terminal by flowing a current corresponding to a pair of differential output currents flowing through the differential pair to the output terminal.

13. The display device according to claim 10, wherein the output amplifier comprises:

a differential pair including a first transistor that receives the positive gradation voltage or the negative gradation voltage at its gate, and a second transistor that receives the gradation data signal output by the output amplifier itself at its gate;

a current source that generates a bias current corresponding to the bias voltage and supplies it to sources of the first and second transistors; and an amplification stage that generates the gradation data signal on the output terminal by flowing a current corresponding to a pair of differential output currents flowing through the differential pair to the output terminal.

14. The display device according to claim 9, wherein the data driver comprises:

a decoder part that converts the brightness level of each pixel based on the image signal into a positive gradation voltage having a positive voltage value or a negative gradation voltage having a negative voltage value;

a first multiplexer that alternately switches between a first state and a second state for each frame period of the image signal, wherein in the first state, the positive gradation voltage is supplied to one output operational amplifier among the output amplifiers, and the negative gradation voltage is supplied to another output operational amplifier among the output amplifiers; and in the second state, the positive gradation voltage is supplied to the another output operational amplifier, and the negative gradation voltage is supplied to the one output operational amplifier; and a second multiplexer that alternately switches, for each frame period of the image signal, between a state in which the first bias voltage is supplied to the one output operational amplifier and the second bias voltage is supplied to the another output operational amplifier, and a state in which the first bias voltage is supplied to the another output operational amplifier and the second bias voltage is supplied to the one output operational amplifier, wherein the one output operational amplifier is an operational amplifier which receives the positive gradation voltage or the negative gradation voltage at its own non-inverting input terminal, and its own inverting input terminal and output terminal are connected to one external terminal among a plurality of external terminals of the data drivers, and the another output operational amplifier is an operational amplifier which receives the negative gradation voltage or the positive gradation voltage at its own non-inverting input terminal, and its own inverting input terminal and output terminal are connected to another external terminal among the external terminals of the data drivers.

15. The display device according to claim 1, wherein the data driver performs a control for lowering the slew rate of the output amplifier responsible for the output of the positive gradation data signal by an amount corresponding to a phase difference between the positive gradation data signal and the negative gradation data signal.

16. The display device according to claim 1, wherein each of the data drivers controls the slew rate of the output amplifier responsible for the output of the positive gradation data signal to be lower than the slew rate of the output amplifier responsible for the output of the negative gradation data signal by an amount corresponding to a phase difference between the positive gradation data signal and the negative gradation data signal.

17. The display device according to claim 9, wherein a plurality of output amplifiers responsible for the output of the positive gradation data signal are divided into a first to U-th positive output amplifier groups, U being an integer of 2 or more, and a plurality of output amplifiers responsible for the output of the negative gradation data signal are divided into a first to U-th negative output amplifier groups, the first bias generation part comprises a first to U-th positive bias parts that individually supplies the first bias voltage to each of the first to U-th positive output amplifier groups, and the second bias generation part comprises a first to U-th negative bias parts that individually supplies the second bias voltage to each of the first to U-th negative output amplifier groups.

18. A data driver which receives an image signal and generates, based on the image signal, a positive gradation data signal higher than a predetermined reference voltage and a negative gradation data signal lower than the predetermined reference voltage, outputs one of the positive gradation data signal and the negative gradation data signal to one data line group of a first data line group and a second data line group of a display panel, and outputs the other of the positive gradation data signal and the negative gradation data signal to the other data line group of the first data line group and the second data line group, wherein the data driver:

comprises a plurality of output amplifiers, wherein each output amplifier outputs one of the positive gradation data signal and the negative gradation data signal;

generates a signal as the positive gradation data signal in which a data pulse having a positive voltage value corresponding to a brightness level of each pixel based on the image signal appears in a predetermined cycle, and generates a signal as the negative gradation data signal in which a data pulse having a negative voltage value corresponding to the brightness level of each pixel based on the image signal appears at every predetermined cycle in a phase shifted in a direction delayed with respect to a phase of the positive gradation data signal; and controls a slew rate of an output amplifier responsible for an output of the positive gradation data signal among the output amplifiers to be lower than a slew rate of an output amplifier responsible for an output of the negative gradation data signal.

19. The data driver according to claim 18, further comprising:

a slew rate control part which generates a slew rate control signal that indicates to lower the slew rate of the output amplifier responsible for the output of the positive gradation data signal by an amount corresponding to a phase difference between the positive gradation data signal and the negative gradation data signal;

a first bias generation part which generates a first bias voltage for the output amplifier responsible for the output of the positive gradation data signal according to the slew rate control signal, wherein the first bias voltage sets a current amount of a bias current flowing in the output amplifier in order to operate the output amplifier; and a second bias generation part which generates a second bias voltage for the output amplifier responsible for the output of the negative gradation data signal, wherein the second bias voltage sets a bias current of a predetermined current amount flowing in the output amplifier in order to operate the output amplifier, wherein the output amplifier responsible for the output of the positive gradation data signal receives the first bias voltage and outputs an output current for generating the gradation data signal based on a bias current corresponding to the first bias voltage, and the output amplifier responsible for the output of the negative gradation data signal receives the second bias voltage and outputs an output current for generating the gradation data signal based on a bias current corresponding to the second bias voltage.

20. The data driver according to claim 19, wherein a plurality of output amplifiers responsible for the output of the positive gradation data signal are divided into a first to U-th positive output amplifier groups, U being an integer of 2 or more, and a plurality of output amplifiers responsible for the output of the negative gradation data signal are divided into a first to U-th negative output amplifier groups, the first bias generation part comprises a first to U-th positive bias parts that individually supplies the first bias voltage to each of the first to U-th positive output amplifier groups, and the second bias generation part comprises a first to U-th negative bias parts that individually supplies the second bias voltage to each of the first to U-th negative output amplifier groups.

* * * * *